US005784034A

United States Patent [19]

Konishi et al.

[11] Patent Number: 5,784,034

[45] Date of Patent: Jul. 21, 1998

[54] ANTENNA APPARATUS

[75] Inventors: Yoshihiko Konishi, Kanagawa; Masataka Ohtsuka, Hyogo; Yoshiyuki Chatani, Kanagawa; Makoto Matsunaga, Kanagawa; Shuji Urasaki, Kanagawa; Takashi Katagi, Kanagawa, all of Japan

[73] Assignee: Mitsubishi Denki Kabushiki Kaisha, Tokyo, Japan

[21] Appl. No.: 789,685

[22] Filed: Jan. 27, 1997

Related U.S. Application Data

[63] Continuation of Ser. No. 340,274, Nov. 15, 1994, abandoned.

[30] Foreign Application Priority Data

Nov. 18, 1993 [JP] Japan ..... 5-289525
Feb. 23, 1994 [JP] Japan ..... 6-025602

[51] Int. Cl.[6] ..... H01Q 1/36

[52] U.S. Cl. ..... 343/895; 343/872

[58] Field of Search ..... 343/822, 853, 343/855, 895, 890, 891, 893, 872, 873

[56] References Cited

U.S. PATENT DOCUMENTS

| | | | |
|---|---|---|---|
| 3,906,509 | 9/1975 | DuHamel . | |
| 4,161,737 | 7/1979 | Albright | 343/895 X |
| 4,223,315 | 9/1980 | Alford | 343/890 X |
| 4,375,642 | 3/1983 | Dorrie et al. | 343/895 |
| 5,138,331 | 8/1992 | Josypenko | 343/895 |
| 5,191,352 | 3/1993 | Branson | 343/895 |
| 5,198,831 | 3/1993 | Burrell et al. | 343/895 |
| 5,255,005 | 10/1993 | Terret et al. | 343/895 |
| 5,307,079 | 4/1994 | Ross et al. | 343/822 |
| 5,346,300 | 9/1994 | Yamamoto et al. | 343/895 |
| 5,406,693 | 4/1995 | Egashida et al. | 343/895 X |
| 5,479,182 | 12/1995 | Sydor | 343/895 |
| 5,485,170 | 1/1996 | Mccarrick | 343/895 |

FOREIGN PATENT DOCUMENTS

| | | |
|---|---|---|
| 3-274906 | 12/1991 | Japan . |
| 6-164232 | 6/1994 | Japan . |
| 6-204726 | 7/1994 | Japan . |
| 2255449 | 3/1991 | United Kingdom . |

OTHER PUBLICATIONS

S. Kuroda "Polarization Characteristics of One Side Shorted Microstrip Antenna" Dec. 1992 Electronics Info Journal.

*Primary Examiner*—Donald T. Hajec
*Assistant Examiner*—Tho Phan
*Attorney, Agent, or Firm*—Wolf, Greenfield & Sacks, P.C.

[57] ABSTRACT

Herein is revealed a helical antenna apparatus wherein the direction of beam radiation hardly changes even if the frequency in use changes. Two helical antennas which are wound with two conductive wires spirally, respectively, at equal intervals with a specified pitch α in the form of a cylinder are disposed along the length of the helical antennas so that the axes thereof substantially coincide with each other. By determining the lengths of the feeders of the respective helical antennas appropriately in order to set the phase of supplied power, it is possible to form the beam of signals radiated into space in the shape of conical beam having a directivity oriented obliquely upward. Additionally, it is possible to obtain the conical beam in which the direction of beam radiation does not change even if the frequency in use is changed.

5 Claims, 38 Drawing Sheets

FIG. 14 a(1)
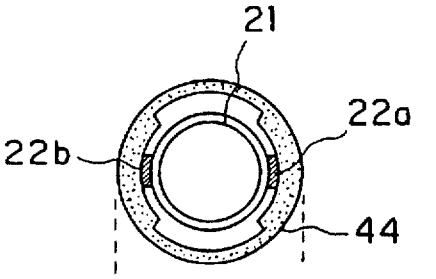
FIG. 14 b(1)
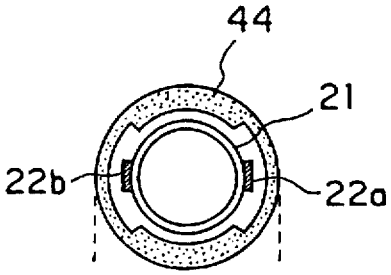
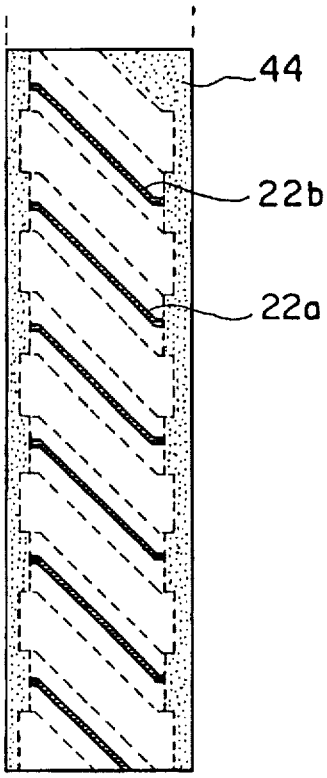
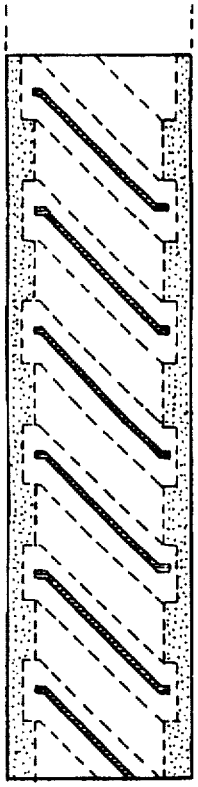
FIG. 14 a(2)
FIG. 14 b(2)

ANTENNA APPARATUS

This application is a continuation of application Ser. No. 08/340,274, filed Nov. 15, 1994, now abandoned.

BACKGROUND OF THE INVENTION

1. Field of the Invention

The present invention relates to an antenna apparatus which is used for mobile phone using satellites, or the like.

2. Description of the Prior Art

FIG. 36 is a construction drawing of the conventional antenna apparatus disclosed in, for example, Japanese Patent Laid-Open No. 3-274906.

Referring to the same Figure, reference numeral 1 designates a cylindrical supporting dielectric and numerals 2a, 2b designate two conductive wires wound around the supporting dielectric 1 at equal intervals with a predetermined pitch angle α to form a so-called two-wire helical antenna. Numeral 3 designates a balanced line connected to a feed terminal of the conductive wires 2a, 2b. Numeral 4 designates a balanced-to-unbalanced converter connected to the balanced line 3. Numeral 5 designates an input/output terminal connected to the balanced-to-unbalanced converter 4.

The operation of the aforementioned apparatus will be described. Signal input from the input/output terminal 5 is fed to the feed terminal of the two-wire helical antenna composed of the conductive wire 2a, 2b through the balanced-to-unbalanced converter 4 and the balanced line 3. The signal is radiated gradually into space while the signal flows through the conductive wires 2a, 2b. When the diameter D of the two-wire helical antenna composed of the conductive wires 2a, 2b and the aforementioned pitch angle α are selected appropriately, the beam radiated into space is conical beam which is symmetrical with the axis of the antenna 6 and directed obliquely upward.

The reason is that the beam direction θ (θ indicates an angle from the axis of two-wire helical antenna as shown in FIG. 37) is expressed by the following expression.

$$\theta = \cos^{-1}\left[\frac{\frac{c}{\pi f D}\cos\alpha - \sqrt{\epsilon_r}}{\sin\alpha}\right]$$

As expressed above, the beam is symmetrical with the center axis of the antenna. Here, D indicates a diameter of the two-wire helical antenna, α indicates a pitch angle, f indicates signal frequency, $\epsilon_r$ indicates transmission dielectric constant of a transmission line constructed by the conductive wires 2a, 2b and c indicates the velocity of light.

FIG. 38 is a perspective view of another conventional antenna apparatus described under the title "Polarization Characteristics of One-Side Shortcircuit Type Micro-Strip Antenna" in Electronic, Information and Communication Engineers Bulletin B-II, Vol. J75-B-II, No.12, pp.999–1000 (December 1992). FIG. 39 is a construction drawing of the antenna apparatus shown in FIG. 38.

Referring to the same Figure, reference numeral 8 designates a conductive ground plate for functioning a zero potential plate (earth plate), numeral 9 designates a rectangular conductive plate having the width w and the length l, placed in parallel to the conductive ground plate 8, numeral 10 designates a rectangular conductive plate for connecting a longer side of the a rectangular conductive plate 9 with the conductive ground plate 8, numeral 11 designates a power feeding conductive probe which is placed between the rectangular conductive plate 9 and the conductive ground plate 8 and which is connected to the rectangular conductive plate 9 on the axis X as shown in FIG. 39, and numeral 12 designates an input/output connector connected to the power feeding conductive probe. Generally, the aforementioned distance h is electrically set to the wavelength of about 1/100 to 5/100 and the length l is set to the wavelength of ¼.

The operation of the aforementioned antenna apparatus will be described. Signal input through the input/output connector 12 is fed to the so-called one-side shortcircuit type micro-strip antenna composed of the conductive ground plate 8, the rectangular conductive plate 9 and the grounding conductive plate 10, through the power feeding conductive probe 11 and then radiated into space. As shown in FIG. 40, the radiation from the one-side shortcircuit type micro-strip antenna can be considered to be radiation from the same-phase magnetic currents M1, M2, M3 placed on three sides which are not connected to the grounding conductive plate 10, of the four sides of the rectangular conductive plate 9. In a plane formed by y and z in FIG. 40, between the magnetic fields radiated from the magnetic currents M1, M3 and the magnetic current M2, polarized wave are perpendicular each other and phases are different by 90°. Consequently, elliptic polarized wave is radiated from the one-side shortcircuit type micro-strip antenna into the y-z plane.

Because, in the conventional helical antenna apparatus shown in FIG. 36, the phases of the signal currents through the two-wire helical antenna composed of the two conductive wires change depending on the frequency in use, if the frequency is low, the direction θ (θ is an angle relative to the axis of the antenna 6) of the radiated beam is small, and on the other hand, if the frequency is high, the direction θ (θ is an angle relative to the axis of the antenna 6) of the beam is large.

Thus, for example, if the frequencies of signals transmitted and received are different from each other, the following problem exists, that is, the directions of the beams differ between the transmitted signal and the received signal.

If the frequency is determined while the diameter D of the winding of the helical antenna and the pitch angle α are fixed, the following problem exists, that is, the direction of the beam cannot be changed so that the freedom of choice is low.

Because the axial symmetry of the construction of the apparatus is deteriorated by a feeder passing inside the helical antenna, the axial symmetry of the characteristic of radiation pattern is deteriorated.

Because the beam radiated from the conventional helical antenna apparatus is of a single-peak, there is such a problem that the angle θ (θ is an angle from the axis of the antenna 6) which can be covered with a predetermined gain is limited.

Because the connecting line is seen as an inductance, the input impedance of the helical antenna becomes inductive, so that the matching of the input impedance is difficult.

In the one-side shortcircuit type micro-strip antenna apparatus shown in FIG. 38, even if the width w of the rectangular conductive plate (the length l is assumed to be the wavelength of approximately ¼), the direction θ (θ is an angle from the axis of the antenna) in which the axial ratio minimizes, indicated by the broken lines does not change, so that it is not possible to select the direction in which the axial ratio minimizes (direction in which circularly polarized wave comes near a real circular shape) freely. In FIG. 42, the real line indicates the direction in which the gain of circularly polarized wave maximizes.

As a problem which can be mentioned additionally, generally if the width w of the rectangular conductive plate shown in FIG. 38 is changed, the input impedance characteristic of the antenna apparatus changes. Therefore, if the direction in which the gain of circularly polarized wave maximizes is set to a certain direction as shown in FIG. 42, a required input impedance characteristic cannot be obtained.

SUMMARY OF THE INVENTION

Accordingly, in views of the aforementioned problems, an object of the present invention is to provide a helical antenna apparatus in which the direction of beam radiation of the helical antenna hardly changes even if the frequency in use is changed.

Another object of the present invention is to provide a helical antenna apparatus capable of controlling the direction of beam even if the frequency in use of the helical antenna is fixed.

Still another object of the present invention is to provide a helical antenna apparatus capable of maintaining the axial symmetry of radiation pattern if a feeder is passed inside the inside of the helical antenna.

A further object of the present invention is to provide a helical antenna apparatus wherein the range of the angle θ (θ is an angle from the axis of the antenna 6) to be covered by a predetermined gain can be enlarged.

A still further object of the present invention is to provide a one-side shortcircuit type micro-strip antenna capable of controlling the direction (angle) in which the axial ratio minimizes.

A yet still further object of the present invention is to provide a one-side shortcircuit type micro-strip antenna apparatus capable of controlling the direction (angle) in which the gain of circular polarization maximizes without changing the input impedance characteristic.

The antenna apparatus according to the first aspect of the present invention comprises a plurality of helical antennas, each antenna is wound with a conductive wire spirally at a predetermined pitch in the form of a cylinder or wound with a plurality of the conductive wires spirally at equal intervals with a predetermined pitch, the helical antennas being disposed along the length thereof so that the axes of the helical antennas substantially coincide with each other and a feeding means for supplying power to the plurality of the aforementioned helical antennas.

According to this antenna apparatus, it is possible to obtain conical beam wherein the beam shape of signals irradiated into space is directed obliquely upward. Further, because the equiphase surface is not changed even if the frequency in use is changed, it is possible to obtain the conical beam in which the radiation direction of beam is not changed.

The antenna apparatus according to the second aspect of the present invention comprises a plurality of the helical antennas, each antenna is wound with a conductive wire spirally at a predetermined pitch in the form of a cylinder or wound with a plurality of the conductive wires spirally at equal intervals with a predetermined pitch, the antenna apparatus being disposed along the length thereof so that the axes of the helical antennas substantially coincide with each other and feeding means for supplying power to the plurality of the aforementioned helical antennas.

According to this antenna apparatus, it is possible to change the radiation direction of the conical beam within a plane including the axes of the respective helical antennas by supplying signals having a predetermined supplied power phase to the respective helical antennas so that the contributions from the respective helical antennas become the same phase in a predetermined direction.

The antenna apparatus according to the third aspect of the present invention comprises a plurality of the helical antennas, each antenna is wound with a conductive wire spirally at a predetermined pitch in the form of a cylinder or wound with a plurality of the conductive wires spirally at equal intervals with a predetermined pitch, the antenna being disposed along the length thereof so that the axes of the helical antennas substantially coincide with each other and feeding means for feeding a signal to the plurality of the aforementioned helical antennas. Further, means for rotating all the helical antennas or part of the helical antennas around the axis of the cylindrical helical antenna is included.

In this antenna apparatus, by rotating a predetermined helical antenna, the difference of phase between the signal radiated from the aforementioned helical antenna and the signal radiated from other fixed helical antenna is changed in the same manner as when a variable phase device is used. Consequently, it is possible to change the radiation direction of the conical beam within a plane including the axis of the helical antennas.

The antenna apparatus according to the fourth aspect of the present invention comprises two helical antennas, each antenna is wound with a conductive wire spirally each at different pitch from each other in the form of a cylinder or two helical antennas, each is wound with a plurality of conductive wires spirally at different pitch from each other in the form of a cylinder, the antennas being disposed along the length thereof so that the axes of the two helical antennas substantially coincide with each other and feeding means for sending a transmission signal to either of the aforementioned two helical antennas and for receiving a reception signal from the other helical antenna.

According to the antenna apparatus according to the present aspect, by using the two helical antennas specifically for signal sending and signal reception, it is possible to equalize the radiation directions of beam from the aforementioned helical antennas even if the frequencies of the transmission signal and reception signal are different from each other.

The antenna apparatus according to the fifth aspect of the present invention comprises a plurality of helical antennas, each antenna is wound with a conductive wire spirally each at a specified pitch or with a plurality of conductive wires spirally at equal intervals with a specified pitch, the antenna being disposed along the length thereof so that the axes of the helical antennas almost coincide with each other and feeding means for supplying signals to a plurality of the aforementioned helical antennas. Further, cylindrical conductive pipes are disposed inside all the aforementioned helical antennas or part of the helical antennas so that the conductive pipes are substantially coaxial with the helical antennas and feeders for the helical antennas are disposed through the inside of the conductive pipes.

The antenna apparatus according to the present aspect is capable of maintaining the axial symmetry in the construction of the helical antenna and the feeders are shielded by the conductive pipes. Thus, it is possible to maintain the rotation symmetry of the beam shape (axial symmetry of radiation pattern).

The antenna apparatus according to the sixth aspect of the present invention comprises a helical antenna which is wound with a conductive wire spirally at a specified pitch in the form of a cylinder or wound with a plurality of the conductive wires spirally at equal intervals with a specified pitch in the form of a cylinder and feeding means for supplying signals to the helical antennas. Further, a cylindrical dielectric radome is disposed around the helical antennas so as to be substantially coaxial therewith.

In the antenna apparatus according to the seventh aspect of the present invention, the aforementioned dielectric radome is replaceable with other dielectric radomes having a different dielectric constant.

By replacing the dielectric radome with other dielectric radomes having a different dielectric constant, the wavelength of signal current flowing on the conductive wire is changed depending on the dielectric radome, so that the radiation direction of the conical beam can be changed within a plane including the axis of the helical antenna.

The antenna apparatus according to the eighth aspect of the present invention comprises a helical antenna which is wound with a conductive wire spirally at a specified pitch in the form of a cylinder or wound with a plurality of the conductive wires spirally at equal intervals with a specified pitch in the form of a cylinder and feeding means for supplying signals to the helical antennas. Further, a cylindrical dielectric radome is provided around the helical antenna so as to be substantially coaxial therewith. The thickness of the radome is changed spirally at substantially the same pitch as the pitch of the helical antenna and the internal surface or the external surface of the dielectric radome is constructed to be of internal thread or external thread.

In this antenna apparatus, if the conductive wire of the helical antenna is located on thick portions of the dielectric radome, wavelength of signal current flowing on the conductive wire is shortened. On the other hand, if the conductive wire of the helical antenna is located on thin portions of the dielectric radome, wavelength of signal current flowing on the conductive wire is not shortened. Thus, the aforementioned construction makes it possible to control the radiation direction of the conical beam.

The antenna apparatus according to the ninth aspect of the present invention comprises a helical antenna which is wound with a conductive wire spirally at a specified pitch in the form of a cylinder or wound with a plurality of the conductive wires spirally at equal intervals with a specified pitch in the form of a cylinder, feeding means connected to the feed terminal of the helical antenna in order to supply signals to the helical antennas and phase changing means which is disposed at a position apart from the feed terminal of the conductive wire of the helical antenna by more than ½ the overall length of the helical antenna and which makes the difference between the phase of the beam radiated from one of the divided section of the helical antenna and the phase of the beam radiated from another divided section to be approximately 180°.

In this antenna apparatus, beam from one of the divided section of the helical antenna is synthesized with beam from another divided section thereof to form a conical beam having double-humped shape within a plane including the axis of the helical antenna, so that the range which can be covered by a required gain can be widened.

The antenna apparatus according to the tenth aspect of the present invention comprises a first helical antennas which is wound with a conductive wire spirally at a specified pitch in the form of a cylinder or wound with a plurality of the conductive wires spirally at equal intervals with a specified pitch in the form of a cylinder, a second helical antenna which is disposed along the length of the first helical antenna so that the axes of the first and second helical antennas substantially coincide with each other and which is wound with the conductive wire spirally at a different pitch from that of the first helical antenna in the form of a cylinder or wound with a plurality of the conductive wires spirally at equal intervals with a specified pitch different from that of the first helical antenna, feeding means which is connected to the each feed terminal of the first helical antenna or the second helical antenna in order to supply signals to the first or second helical antennas, and phase changing means which is located at a position apart from the feed terminal of the conductive wires of the first and second helical antennas by more than ½ the overall length of the helical antenna and which makes the difference between the phase of beam radiated from one of the divided sections of the helical antenna and the phase of beam radiated from the other divided section of the helical antenna to be approximately 180°, the antenna apparatus according to the tenth aspect sending a transmission signal to one of the first helical antenna or the second helical antenna and receiving a reception signal from the other helical antenna.

The antenna apparatus according to the present aspect makes it possible to equalize the radiation direction of the conical beam having twin-peak shape within a plane including the axis of the helical antennas even if the frequencies of the transmission signal and reception signal differ from each other.

The antenna apparatus according to the eleventh aspect of the present invention comprises a helical antenna which is wound with at least one of two conductive wires spirally at equal intervals with a specified pitch in the form of a cylinder, a balanced-to-unbalanced converter connected to the feed terminal of the helical antenna and feeders connected to the balanced-to-unbalanced converter, the conductive lines being formed as lines for connecting the helical antenna feed terminal to the balanced-to-unbalanced converter such that the width of the lines gradually changes.

In this antenna apparatus, by using the conductive lines in which the width thereof gradually changes as the lines for connecting the helical antenna feed terminal to the balanced-to-unbalanced converter, it is possible to reduce the inductance of the connecting lines. Consequently, the matching of the input impedance of the helical antenna can be facilitated.

The antenna apparatus according to the twelfth aspect of the present invention comprises a helical antenna which is wound with at least one of two conductive wires spirally at equal intervals with a specified pitch in the form of a cylinder, a balanced-to-unbalanced converter connected to the feed terminal of the helical antenna and feeders connected to the balanced-to-unbalanced converter, the balanced-to-unbalanced converter being a split coaxial type balun having two slits formed on the external conductor of the coaxial line while the length of the slits of the split coaxial balun is set to electrically ¼ to ½ of wavelength in use.

In this antenna apparatus, the balanced-to-unbalanced converter 24 is capacitive, eliminating the inductance of the input impedance, so that the matching of the input impedance can be facilitated.

The antenna apparatus according to the thirtieth aspect of the present invention comprises a conductive ground plate, a partially elliptic or polygon conductive plate which is placed at a position apart from the conductive ground plate by electrically approximately 1/100 to 5/100 of wavelength in parallel to the conductive ground plate, a grounding conductive plate which connects one side of the conductive plate to the conductive ground plate, and a power feeding conductive probe which is placed between the conductive ground plate and the conductive plate and which is connected to the conductive plate, the dimension of the conductive plate, which is perpendicular to the side of the conductive plate connected to the grounding conductive plate being electrically approximately ¼ of wavelength and circularly polarized waves being radiated in a predetermined direction within a plane which includes the side of the conductive plate connected to the grounding conductive plate and which is perpendicular to the conductive ground plate.

In this antenna apparatus, if the conductive plate is formed so as to be close to a trapezoid in which the side connected to the grounding conductive plate is the lower bottom and in which the height thereof is electrically approximately ¼ the wavelength, it is possible to control the direction for minimizing the axial ratio of circular polarization in a predetermined direction within a plane which includes the side of the conductive plate, connected to the grounding conductive plate and which is perpendicular to the aforementioned conductive ground plate, by changing the upper bottom of a shape close to the trapezoid. Additionally, it is possible to control the direction in which the circular polarization gain maximizes without changing the input impedance characteristic.

The antenna apparatus according to the fourteenth aspect of the present invention comprises a conductive ground plate, a trapezoid conductive plate which is placed at a position apart from the conductive ground plate by electrically approximately 1/100 to 5/100 of wavelength in parallel to the conductive ground plate and which has the height of electrically approximately ¼ of wavelength, and a feeding conductive probe which is placed between the conductive ground plate and the trapezoid conductive plate and which is connected to the trapezoid conductive plate, the antenna apparatus radiating circularly polarized waves in a predetermined direction within a plane which includes the bottom side of the trapezoid conductive plate and which is perpendicular to the conductive ground plate.

In this antenna apparatus, by changing the dimension of the upper bottom of the trapezoid conductive plate, it is possible to control the direction in which the axial ratio of circular polarization is minimized within a plane which includes the bottom side of the trapezoid conductive plate and which is perpendicular to the conductive ground plate. Additionally, it is possible to control the direction in which the circular polarization gain is maximized without changing the input impedance characteristic so much.

The antenna apparatus according to the fifteenth aspect of the present invention comprises first and second partially elliptic conductive plates or first and second polygon conductive plates which are placed at positions apart from the conductive ground plate by electrically approximately 1/100 to 5/100 of wavelength so as to overlap the conductive ground plate and which have a side within a plane which is substantially perpendicular to the conductive ground plate, a grounding conductive plate for connecting one side of the first and second conductive plates to the conductive ground plate and a power feeding conductive probe which is placed between the conductive ground plate and the first conductive plate and which is connected to the first conductive plate, the dimension which is perpendicular to the sides of the first and second conductive plates, connected to the grounding conductive plate being electrically approximately ¼ of wavelength, said antenna radiating circularly polarized waves in a predetermined direction within a plane which includes the sides of the first and second conductive plates, connected to the grounding conductive plate and which is perpendicular to the grounding base plate.

In this antenna apparatus, if the conductive plate is formed so as to be close to a trapezoid in which the side of the conductive plate, connected to the grounding conductive plate is the lower bottom and in which the height thereof is electrically approximately ¼ of wavelength, it is possible to control the direction for minimizing the axial ratio of circular polarization in a predetermined direction within a plane which includes the side of the conductive plate, connected to the grounding conductive plate and which is perpendicular to the aforementioned conductive ground plate, by changing the upper bottom. Additionally, it is possible to control the direction in which the circular polarization gain maximizes without changing the input impedance characteristic.

The antenna apparatus according to the sixteenth aspect of the present invention comprises first and second trapezoid conductive plates which are placed at positions apart from the conductive ground plate by electrically approximately 1/100 to 5/100 of wavelength so as to overlap the conductive ground plate and which have a side within a plane which is substantially perpendicular to the conductive ground plate, a grounding conductive plate for connecting a bottom side of the first and second conductive plates to the conductive ground plate and a power feeding conductive probe which is placed between the conductive ground plate and the first conductive plate and which is connected to the first conductive plate, said antenna radiating circularly polarized waves in a predetermined direction within a plane which includes the bottom sides of the first and second conductive plates and which is perpendicular to the grounding base plate.

In this antenna apparatus, it is possible to control the direction in which the axial ratio of circular polarization minimizes in a predetermined direction within a plane which includes the sides of the conductive plates, connected to the grounding conductive plate and which is perpendicular to the conductive ground plate by changing the dimension of the upper bottom of the conductive plates. Additionally, it is possible to control the direction in which the circular polarization gain maximizes without changing the input impedance characteristic so much.

The antenna apparatus according to the seventeenth aspect of the present invention comprises a conductive ground plate, a plurality of antenna elements arranged on the conductive ground plate substantially in the same direction, the feeding means for feeding a signal to the plurality of the antenna elements, the respective antenna elements comprising a partially elliptic or polygon conductive plate which is placed at a position apart from the conductive ground plate by electrically approximately 1/100 to 5/100 of wavelength, the grounding conductive plate which connects a side of the conductive plate to the conductive ground plate, and the power feeding conductive probe which is placed between the conductive ground plate and the conductive plate and which is connected to the conductive plate, the dimension which is perpendicular to the side of the conductive plate, connected to the grounding conductive plate, being electrically approximately ¼ of wavelength, said antenna radiating circularly polarized waves in a required direction within a plane which includes the side of the conductive plate, connected to the grounding conductive plate and which is perpendicular to the conductive ground plate.

This antenna apparatus comprises a plurality of the antenna apparatuses based on the eleventh aspect as an antenna element, which are arranged on the conductive ground plate substantially in the same direction. This antenna apparatus is capable of forming circularly polarized beam in a predetermined direction within a plane which includes the side of the conductive plate of respective antenna element, connected to the grounding conductive plate and which is perpendicular to the conductive ground plate.

The antenna apparatus according to the eighteenth aspect of the present invention comprises the conductive ground plate, a plurality of the antenna elements arranged on the conductive ground plate substantially in the same direction and the feeding means for supplying power to the plurality of the antenna elements, the respective antenna elements comprising trapezoid conductive plates which are placed at a position apart from the conductive ground plate by electrically approximately 1/100 to 5/100 of wavelength and which have the height of electrically approximately 1/4 the wavelength, the grounding conductive plate which connects a bottom of the trapezoid to the conductive ground plate, and a feeding conductive probe which is placed between the conductive ground plate and the trapezoid conductive plate and which is connected to the trapezoid conductive plate, said antenna apparatus radiating circularly polarized waves in a predetermined direction within a plane which includes the bottom side of the trapezoid conductive plate and which is perpendicular to the aforementioned conductive ground plate.

This antenna apparatus comprises a plurality of the antenna apparatuses based on the twelfth aspect as an antenna element, which are arranged on the conductive ground plate substantially in the same direction. This antenna apparatus is capable of forming circularly polarized beam in a predetermined direction within a plane which includes a bottom side of the trapezoid conductive plate of respective antenna elements, connected to the grounding conductive plate and which is perpendicular to the conductive ground plate.

The antenna apparatus according to the nineteenth aspect of the present invention comprises a conductive ground plate, a plurality of the antenna elements which are arranged on the conductive ground plate substantially in the same direction and feeding means for feeding a signal to the plurality of the antenna elements, the respective antenna elements comprising first and second conductive plates or first and second polygon conductive plates which are placed at the intervals of electrically approximately 1/100 to 5/100 of wavelength apart from the conductive ground plate in parallel to the conductive ground plate so as to make the first and second conductive plates overlap each other and which have a side within a plane which is substantially perpendicular to the conductive ground plate, a grounding conductive plate which connects each one side of the first and second conductive plates to the grounding base plate and the power feeding probe which is placed between the conductive ground plate and the first conductive plate and which is connected to the first conductive plate, the dimensions which are perpendicular to the sides of the first and second conductive plates, connected to the grounding conductive plate, being electrically approximately 1/4 of wavelength, said antenna apparatus radiating circularly polarized waves in a predetermined direction within a plane which includes the sides of the first and second conductive plates, connected to the grounding conductive plate and which is perpendicular to the conductive ground plate.

This antenna apparatus comprises a plurality of the antenna apparatuses based on the thirteenth aspect of the present invention as an antenna element, which are arranged on the conductive ground plate substantially in the same direction. This antenna apparatus is capable of forming circularly polarized beam in a predetermined direction within a plane which includes the sides of the first and second conductive plates of the respective antenna element, connected to the grounding conductive plate and which is perpendicular to the conductive ground plate.

The antenna apparatus according to the twentieth aspect of the present invention comprises a conductive ground plate, a plurality of the antenna elements which are arranged on the conductive ground plate substantially in the same direction and feeding means for feeding a signal to the plurality of the antenna elements, the respective antenna elements comprising first and second trapezoid conductive plates which are placed at the intervals of electrically approximately 1/100 to 5/100 of wavelength apart from the conductive ground plate in parallel to the conductive ground plate so as to make the first and second trapezoid conductive plates overlap each other and which have a side within a plane which is substantially perpendicular to the conductive ground plate, a grounding conductive plate which connects each one side of the first and second trapezoid conductive plates to the grounding base plate and the power feeding probe which is placed between the conductive ground plate and the first trapezoid conductive plate and which is connected to the first trapezoid conductive plate, said antenna apparatus radiating circularly polarized waves in a predetermined direction within a plane which includes the bottom sides of the first and second trapezoid conductive plates and which is perpendicular to the conductive ground plate.

This antenna apparatus comprises a plurality of the antenna apparatuses based on the fourteenth aspect as an antenna element, which are arranged on the conductive ground plate substantially in the same direction. This antenna apparatus is capable of forming circularly polarized beam in a predetermined direction within a plane which includes each one bottom side of the first and second trapezoid conductive plates of the respective antenna element, connected to the grounding conductive plate and which is perpendicular to the aforementioned conductive ground plate.

BRIEF DESCRIPTION OF THE DRAWINGS

FIGS. 14*a*, 14*b* are longitudinally sectional views of the antenna apparatus.

DESCRIPTION OF THE PREFERRED EMBODIMENT

Embodiment 1

Figure 1:
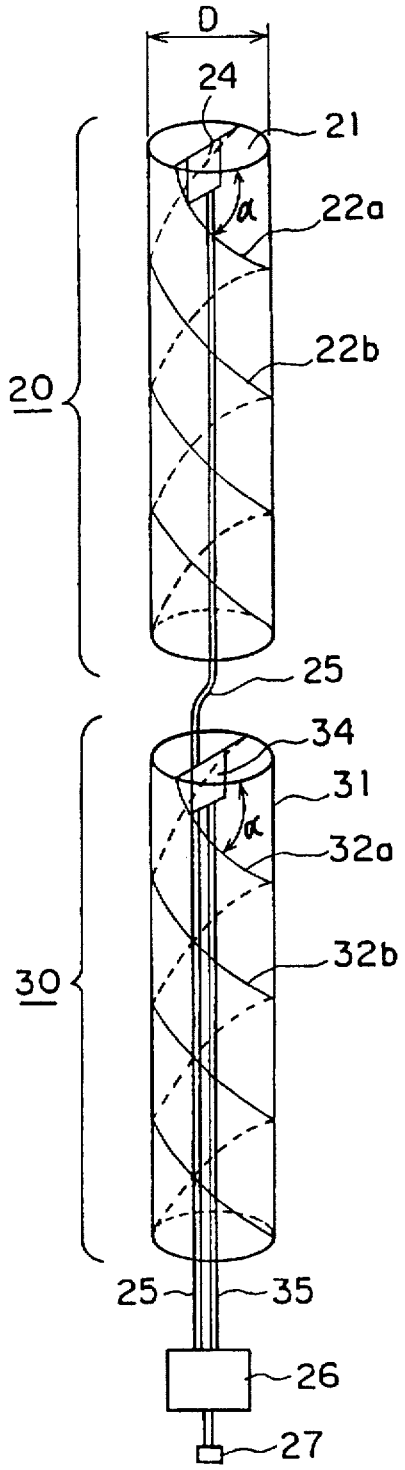
FIG. 1 is a construction drawing of the antenna apparatus according to the first embodiment of the present invention.

FIG. 1 is a construction drawing of the antenna apparatus according to the first embodiment of the present invention. Referring to the same Figure, reference numerals 21, 31 designate supporting dielectrics. The supporting dielectric 21 and the supporting dielectric 31 are disposed along the axes so that the axes thereof almost coincide with each other. Numerals 22*a*, 22*b* designate two conductive wires wound around the supporting dielectric 21 at equal intervals with a constant pitch angle α, thereby composing a so-called two-wire helical antenna 20. Numerals 32*a*, 32*b* designate two conductive wires wound around the supporting dielectric 31 at equal intervals with a constant pitch angle α, thereby forming a two-wire helical antenna 30. Numerals 24, 34 designate balanced-to-unbalanced converters which are connected to the conductive wires 22*a*, 22*b* and 32*a*, 32*b* respectively and placed within the supporting dielectrics 21, 31, respectively. Numerals 25, 35 designate coaxial lines which are connected to the balanced-to-unbalanced converters 24, 34 and placed within the supporting dielectrics 21, 31. Numeral 26 designates a distributor which is connected to the coaxial lines 25, 35 to distribute signals to the coaxial lines 25, 35. Numeral 27 designates an input/output terminal connected to the distributor 26.

Then, the operation of the antenna apparatus according to the first embodiment of the present invention will be described. Signal input from the input/output terminal 27 is distributed by means of the distributor 26 and each outputs to the coaxial line 25 or 35. The signals transmitted through the coaxial lines 25, 35 are feed to respective feed terminals of the two-wire helical antenna 20 composed of the conductive wires 22*a*, 22*b* and the two-wire helical antenna 30 composed of the conductive wires 32*a*, 32*b*. The signals flow through the conductive wires 22*a*, 22*b* and the conductive wires 32*a*, 32*b* while being radiated gradually into space.

In this embodiment, the direction of beam radiation is substantially determined by a difference of feed phase between the two-wire helical antenna 20 and the two-wire helical antenna 30 and the difference of the feed phase changes in proportion to frequencies. Thus, if the frequency in use changes, that change is eliminated by the change of the feed phase, so that the equiphase plane is not changed. Thus, conical beam in which the direction of beam radiation does not change is assured.

In case diameters D of the two-wire helical antennas 20, 30 and pitch angle $\alpha$ are suitably selected, the directions of the beams radiated from the two-wire helical antennas 20, 30 to space becomes to be cone beams which center axes turn to direction $\theta$ respectively. That is the beams turn to obliquely upward direction, in the same manner of the conventional apparatus.

When length of the coaxial line 25 is set longer than of the coaxial line 35 so that a difference $\psi$ of feed phases of the two-wire helical antennas 20, 30 is expressed by;

$$\psi=(2\pi f/c)\Delta L \cos\theta$$

and a signal is fed to the two-wire helical antennas 20, 30, a beam set by array factor of the helical antennas 20, 30 becomes also a cone beam directing to angle $\theta$. The beam radiated from the antenna apparatus is expressed by the product of respect beams from the helical antennas 20, 30 and the beam defined by the array factor. Consequently, the angle of the beam becomes naturally $\theta$.

Here, f indicates signal frequency, c indicates the velocity of light and $\Delta L$ indicates a distance between the two-wire helical antennas 20 and 30.

The relationship between a difference $\Delta L_g$, of length of the two-wire helical antennas 20, 30 and a difference of feed phases is expressed by following equation.

$$\psi=\frac{2\pi f\sqrt{\epsilon_{rg}}}{c}\Delta\times L_g$$

Here, $\epsilon_{rg}$ indicates dielectric constant of the dielectric which is material of the coaxial lines 25, 35.

In this embodiment, when a signal frequency is changed, directions of beams radiated from the two-wire helical antennas 20, 30 change respectively in the same manner of conventional apparatus. However, the direction of the beam radiated defined by the array factor does not depend on the frequency f as expressed by the following equation.

$$\theta=\cos^{-1}\left[\frac{\sqrt{\epsilon_{rg}}\ \Delta L_g}{\Delta L}\right]$$

This equation is introduced by previous two equations.

Accordingly, if the frequency is changed, the direction of the beam radiated from the antenna apparatus hardly moves from a desired direction indicated by angle $\theta$.

Embodiment 2

In the first embodiment, although two helical antennas or two-wire helical antennas 20, 30 are disposed along the axes thereof, it is permissible to dispose two or more, arbitrary number of helical antennas and feed signals to the respective helical antennas at a predetermined feed phase. In this case also, it is possible to obtain a conical beam in which the direction of beam radiation does not change even if the frequency in use is changed.

Embodiment 3

In the first embodiment, although the balanced-to-unbalanced converters 24, 34 and the coaxial lines 25, 35 are disposed within the two-wire helical antennas 20, 30, it is permissible to dispose the balanced-to-unbalanced converters and the coaxial lines outside the two-wire helical antennas 20, 30. In this case also, it is possible to obtain a conical beam in which the direction of beam radiation does not change even if the frequency in use is changed.

Embodiment 4

In the first embodiment, although the two-wire helical antennas 20, 30 composed of the two conductive wires 22*a*, 22*b* and 32*a*, 32*b* respectively are used, it is permissible to use a single-wire helical antenna wound with a single conductive wire at the pitch angle a or a multi-wire helical antenna wound with three or more conductive wires at the same intervals with the pitch angle $\alpha$. In this case also, it is possible to obtain a conical beam in which the direction of beam radiation does not change even if the frequency in use is changed.

Embodiment 5

As the balanced-to-unbalanced converters 24, 34 according to the first embodiment of the present invention, various types are available. For example, a split coaxial type balun having slits which are disposed on both side faces of external conductors of the coaxial line, branching conductive type balun, Sperrtopf and balanced-to-unbalanced transformer are available. That is, even if the type of the balanced-to-unbalanced converter is not restricted to a particular type, it is possible to obtain a conical beam in which the direction of beam radiation does not change if the frequency in use is changed.

Embodiment 6

In the first embodiment of the present invention, although the balanced-to-unbalanced converters 24, 34 and the coaxial lines 25, 35 are used for supply of power, it is permissible to use a balanced line and a balanced-to-unbalanced converter as in conventional type. In this case also, it is possible to obtain a conical beam in which the direction of beam radiation does not change even if the frequency in use is changed.

Embodiment 7

Figure 2:
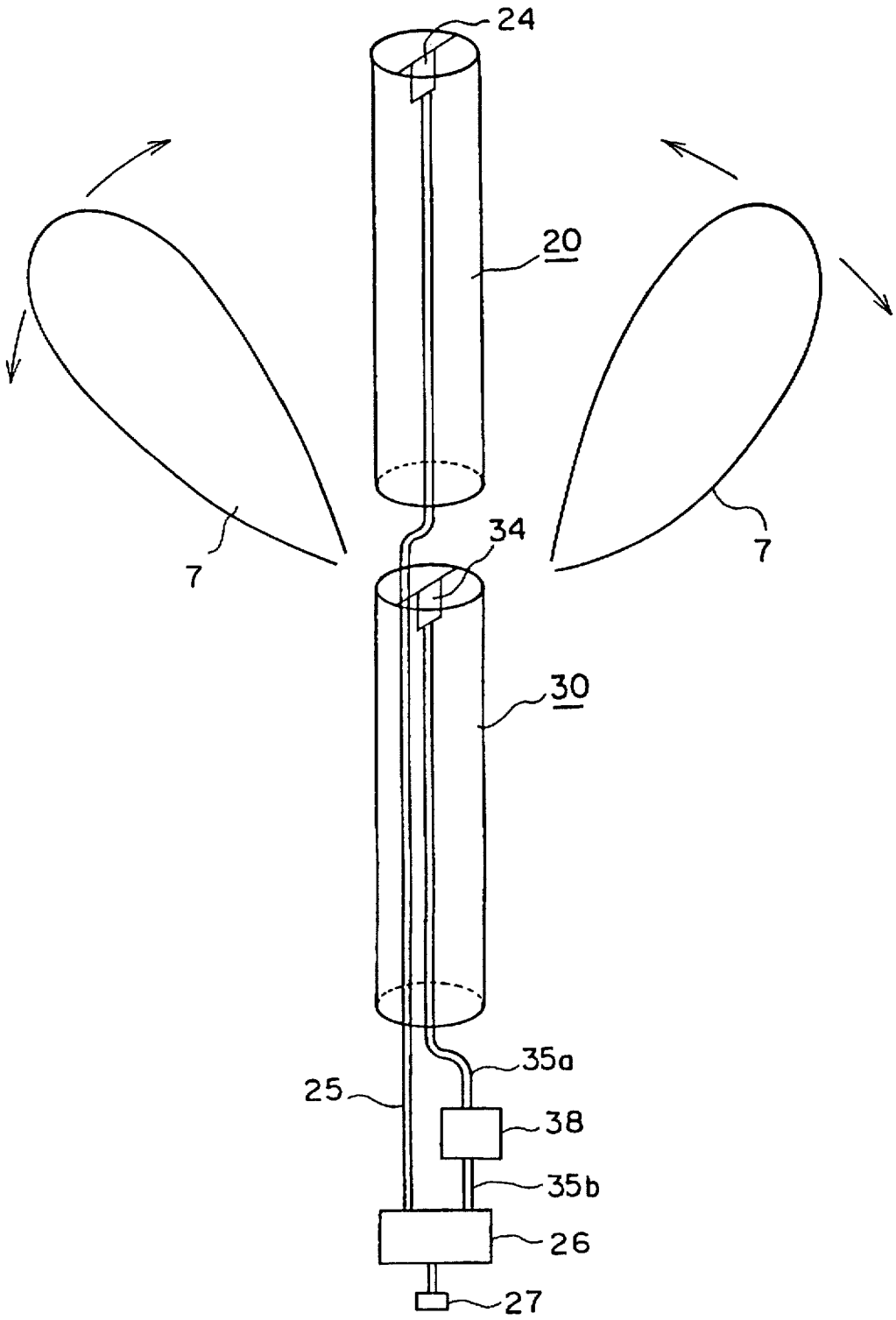
FIG. 2 is a construction drawing of the antenna apparatus according to the seventh embodiment of the present invention.

FIG. 2 is a construction drawing of the antenna apparatus according to the seventh embodiment of the present invention. In this antenna apparatus, the coaxial line 35 according to the first embodiment as shown in FIG. 1 is divided to two coaxial lines 35*a*, 35*b* and a phase control device 38 for changing the phase of signals is placed between the coaxial line 35*a* and the coaxial line 35*b*. In this case, the difference of feed phase between the two-wire helical antenna 20 and the two-wire helical antenna 30 can be changed by means of the phase control device 38 and therefore, it is possible to change the direction of the radiation of the conical beam 7 within plane including the axis of the two-wire helical antennas 20, 30.

Embodiment 8

Figure 3A:
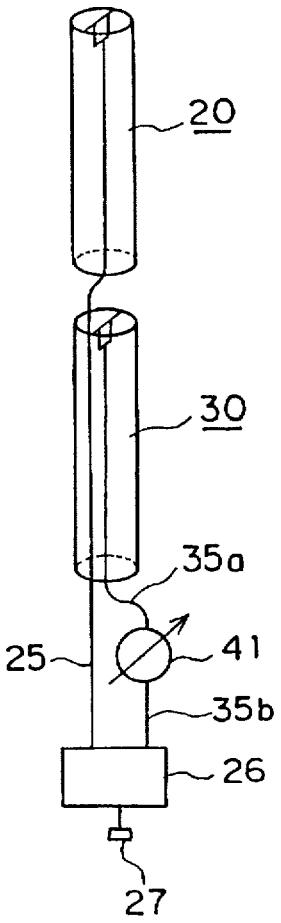
FIGS. 3*a*–3*c* are construction drawings of the antenna apparatus according to the eighth embodiment of the present invention.
Figure 3B:
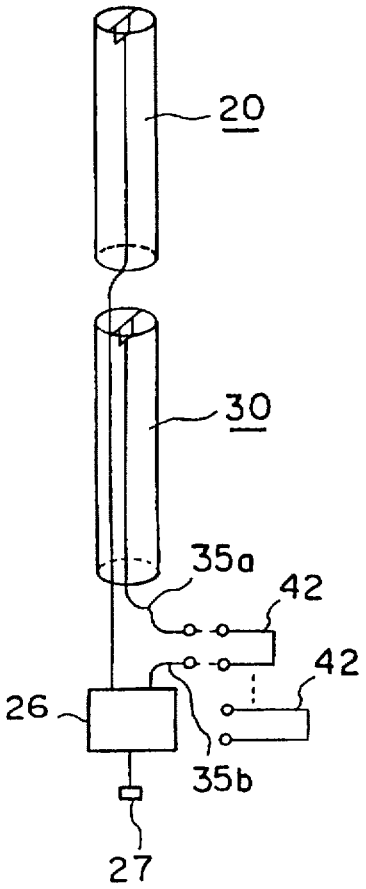
Figure 3C:
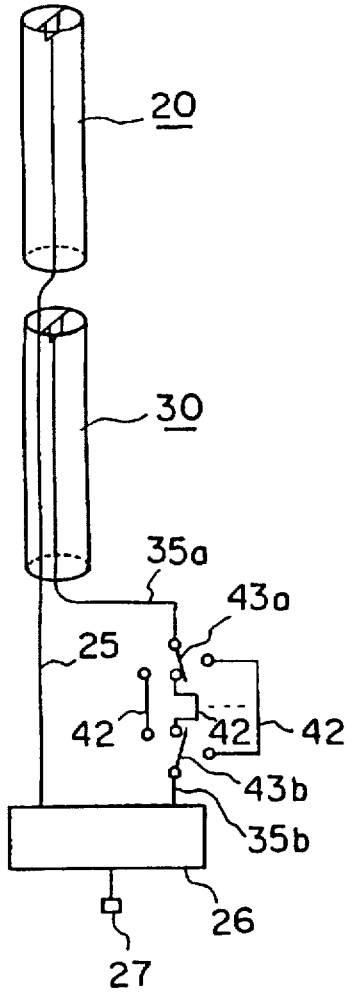

As the phase control device 38 shown in FIG. 2, a variable phase device 41 shown in FIG. 3*a* can be used. Further, it is possible to realize the phase control device 38 which allows multiple phase shift lines 42 having different lengths to be replaced as shown in FIG. 3*b*. Still further, it is possible to realize the phase control device 38 in which multiple phase shift lines 42 having different lengths are switched by means of switches 43a, 43b. In any cases, it is possible to change the direction of the radiation of the conical beam 7 within the plane including the axis of the two-wire helical antennas 20, 30.

Embodiment 9

In the seventh embodiment of the present invention, although the phase control device 38 is placed between the coaxial lines 35a and 35b for feeding signals to the two-wire helical antenna 30, it is permissible to connect the phase control device 38 to the coaxial line 25 for feeding a signal to the two-wire helical antenna 20. In this case also, it is possible to change the direction of the radiation of the conical beam 7 within the plane including the two-wire helical antennas 20, 30. Also by connecting two phase control devices 38 to the two-wire helical antenna 20 and the two-wire helical antenna 30, it is possible to change the direction of the radiation of the conical beam within the plane including the axis of the two-wire helical antennas 20, 30.

Embodiment 10

Figure 4:
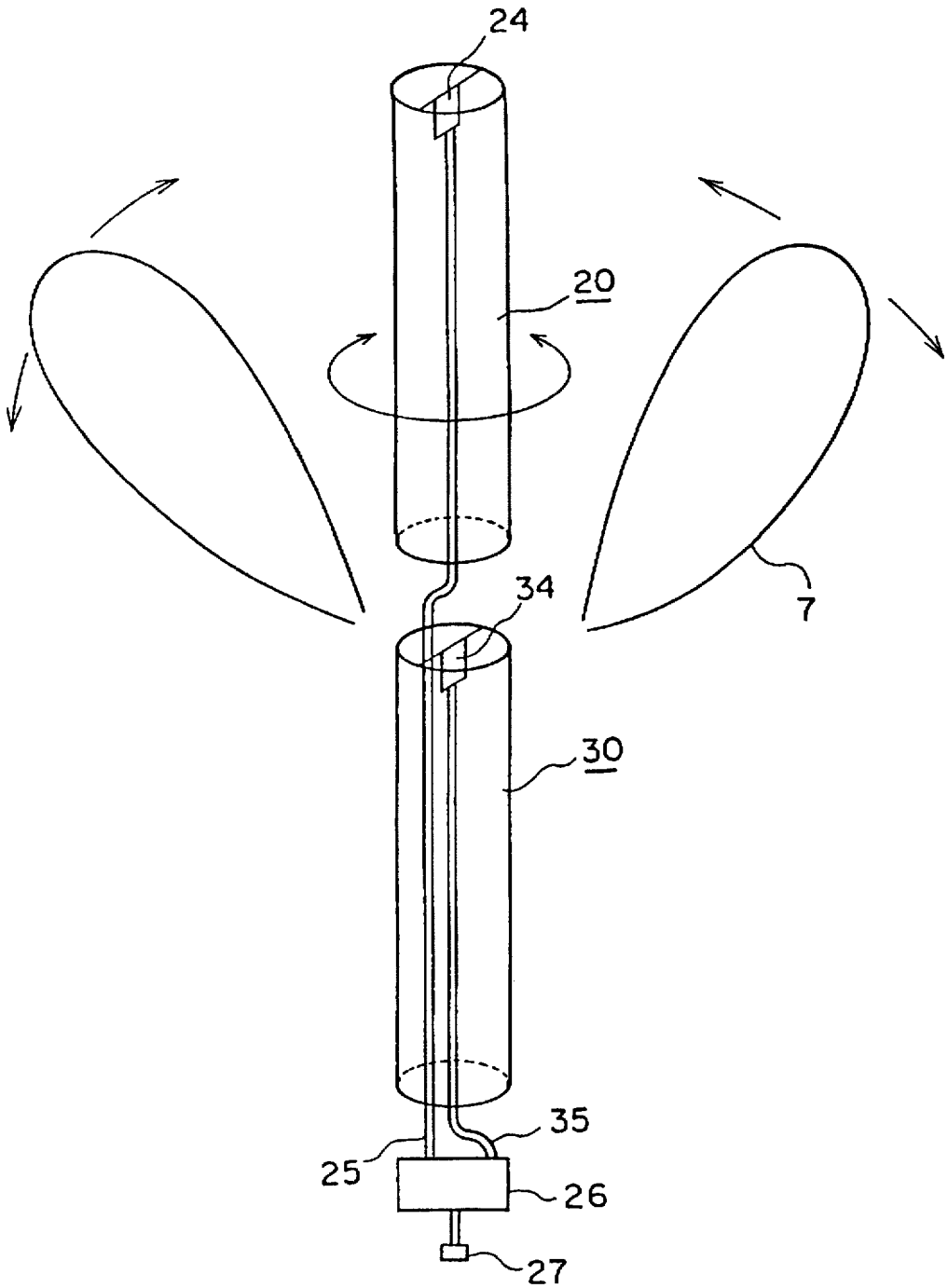
FIG. 4 is a construction drawing of the antenna apparatus according to the tenth embodiment of the present invention.

FIG. 4 is a construction drawing of the antenna apparatus according to the tenth embodiment of the present invention. According to this embodiment, the two-wire helical antenna 20 according to the first embodiment as shown in FIG. 1 can be rotated relative to the axis of the cylinder.

For example, when a coaxial cable which is bent easily is adopted as the coaxial line 25, it becomes possible to rotate cylindrical supporting dielectric 21 of the two-wire helical antenna 20 by hand cantering around the coaxial cable.

The phases of signals (circularly polarized radio waves) radiated from the two-wire helical antenna 20 into space changes by 360° around the cylinder. Thus, by rotating the two-wire helical antenna 20, the difference in phase between the signal radiated from the two-wire helical antenna 20 and the signal radiated from the two-wire helical antenna 30 is changed as when the variable phase device is used, so that the direction of the radiation of the conical beam 7 can be changed within the plane including the axis of the two-wire helical antennas 20, 30.

Embodiment 11

Figure 5:
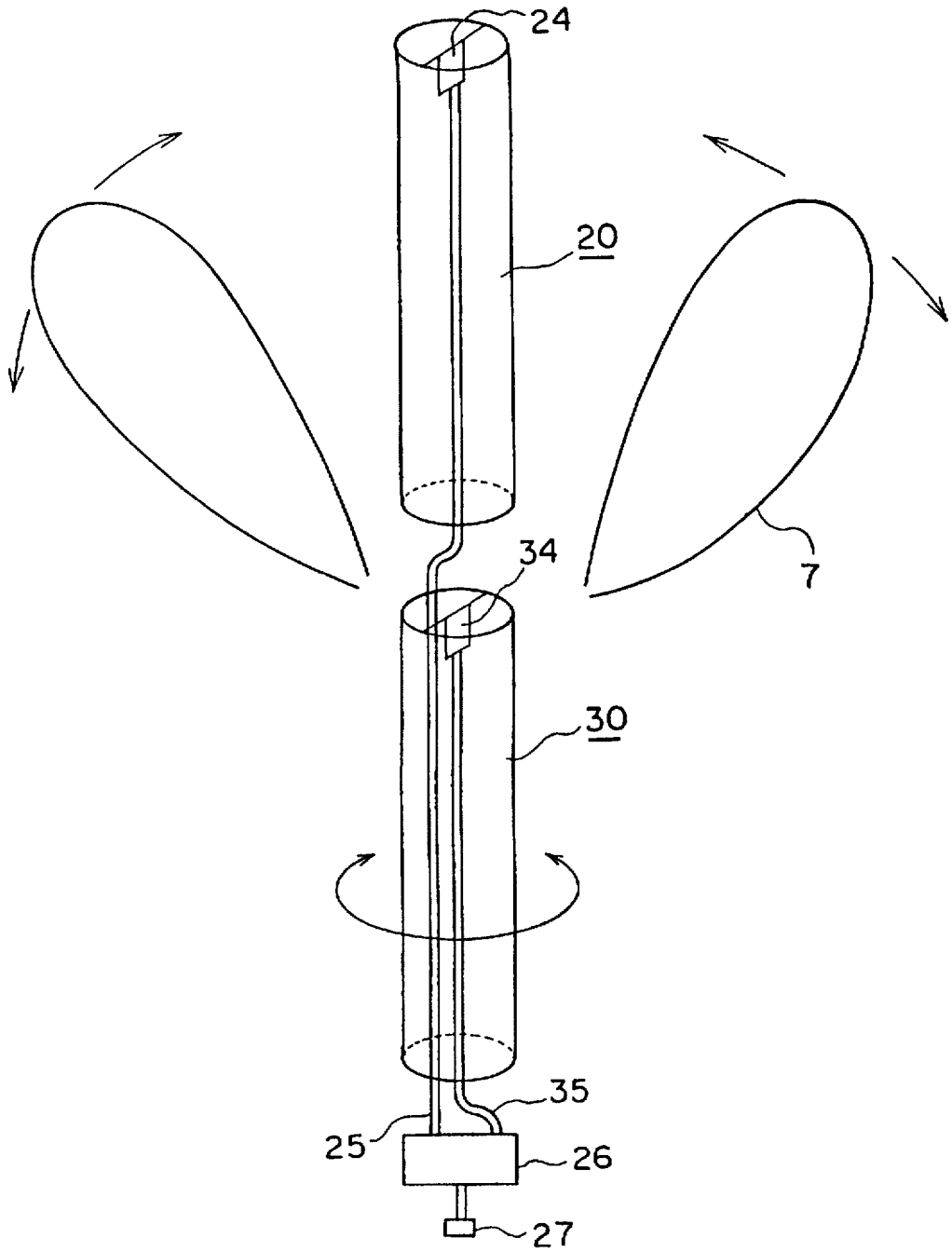
FIG. 5 is a construction drawing of the antenna apparatus according to the eleventh embodiment of the present invention.

Although the tenth embodiment of the present invention is constructed so that the two-wire helical antenna 20 can be rotated relative to the center of the two-wire helical antenna, by rotating the two-wire helical antenna 20 as shown in FIG. 5 also, it is possible to change the direction of the radiation of the conical beam 7 within the plane including the axis of the two-wire helical antenna 30. Further, it is permissible to rotate both the two-wire helical antennas 20, 30. In this case also, it is possible to change the direction of the radiation of the conical beam 7 within the plane including the axis of the two-wire helical antennas 20, 30.

Embodiment 12

Figure 6:
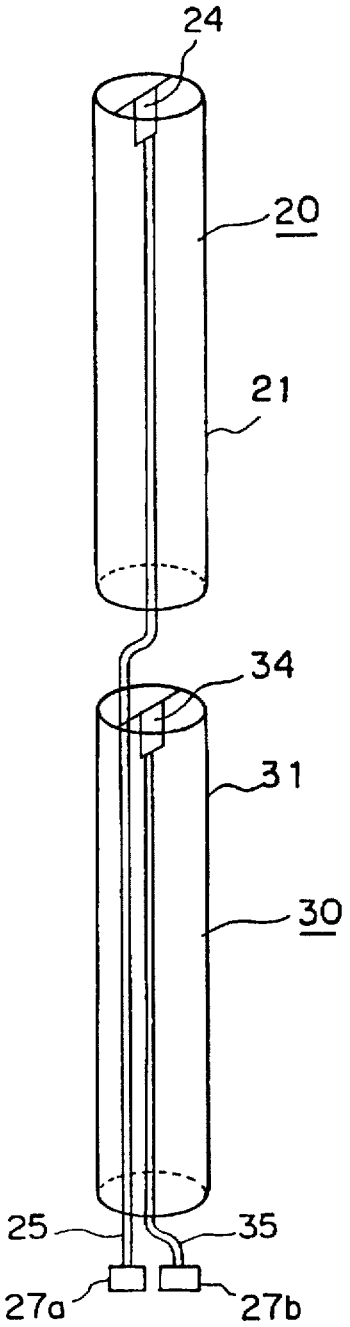
FIG. 6 is a construction drawing of the antenna apparatus according to the twelfth embodiment of the present invention.

FIG. 6 is a construction drawing of the antenna apparatus according to the twelfth embodiment of the present invention. Referring to the same Figure, reference numerals 21, 31 designate cylindrical supporting dielectrics. The supporting dielectric 21 and the supporting dielectric 31 are disposed along the length of the axes thereof so that the axes of the supporting dielectrics 21, 31 substantially coincide with each other.

The two-wire helical antenna 20 is constructed by winding the circumference of the supporting dielectric 21 with two conductive wire (not shown) at equal intervals with a constant pitch angle $\alpha 1$.

Further, the two-wire helical antenna 30 is constructed by winding the circumference of the supporting dielectric 31 with two conductive wires (not shown) at a pitch angle $\alpha 2$ different from the pitch angle $\alpha 1$ of the helical antenna 20.

Reference numerals 24, 34 designate balanced-to-unbalanced converter which are connected to the respective conductive wires of the helical antennas 20, 30 and which are placed in the supporting dielectrics 21, 31. Numerals 25, 35 designate coaxial lines which are connected to the balanced-to-unbalanced converters 24, 34 and which are placed in the supporting dielectrics 21, 31. Numeral 27a designates a transmission signal terminal for transmitting a transmission signal to the coaxial line 25. Numeral 27b designates a reception signal terminal for receiving a reception signal from the coaxial line 35.

Then, the operation of the antenna apparatus according to the present embodiment will be described. Feeding means is provided to send a transmission signal to the helical antenna 20 and receive a reception signal from the helical antenna 30. Thus, by using the two helical antennas 20, 30 particularly for signal sending and reception, respectively, it is possible to make the direction of beam radiation the same as each other even if the frequencies of transmission signals and reception signals are different.

Although the two-wire helical antenna has been explained above, the helical antenna is not restricted to the content of this description. It is permissible to use either helical antenna as a sending antenna.

Embodiment 13

Figure 7:
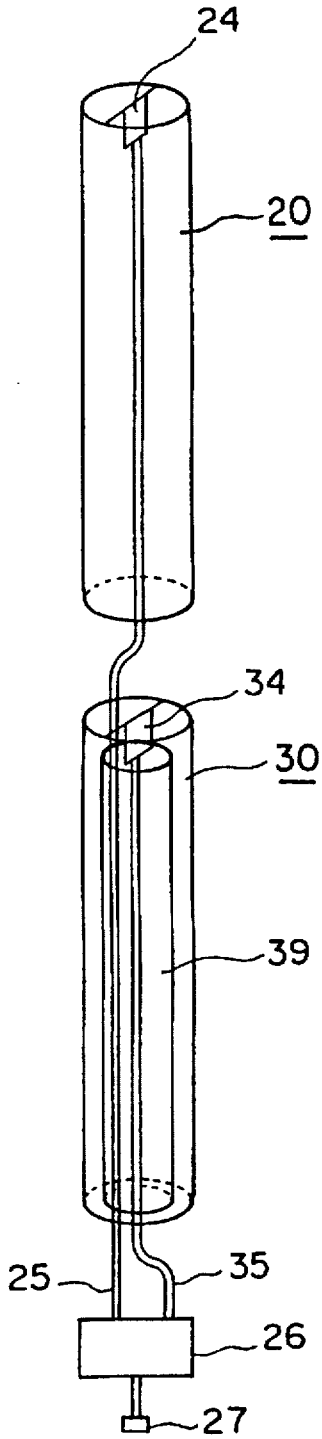
FIG. 7 is a construction drawing of the antenna apparatus according to the thirteenth embodiment of the present invention.
Figure 8:
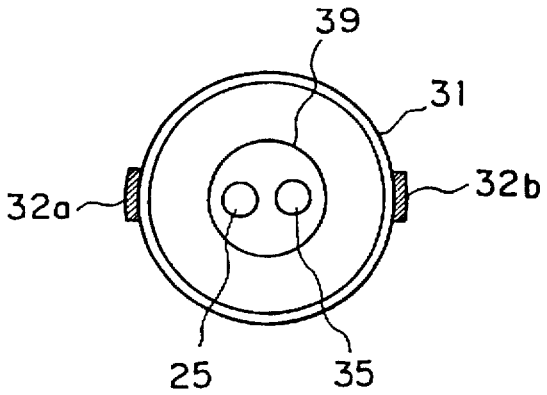
FIG. 8 is a sectional view of the antenna apparatus shown in FIG. 7.
Figure 9:
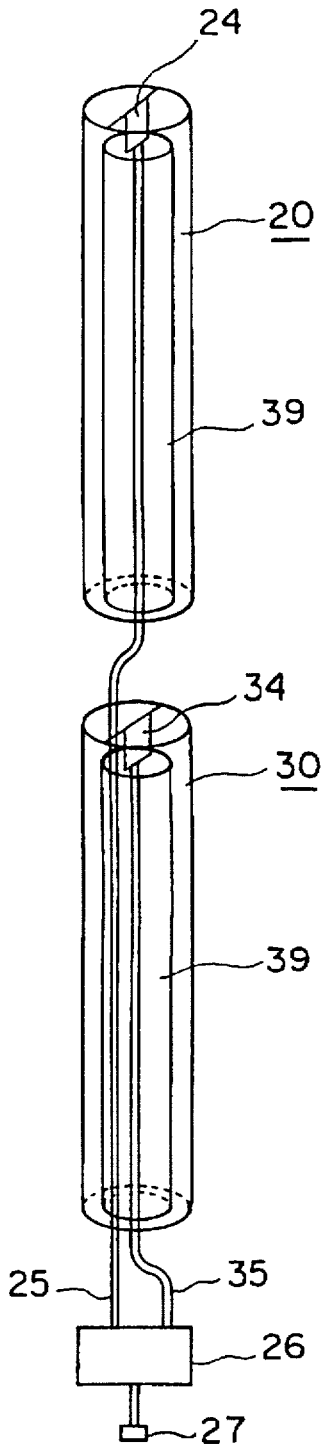
FIG. 9 is a construction drawing of the antenna apparatus according to the fourteenth embodiment of the present invention.

FIG. 7 is a construction drawing of the antenna apparatus according to the thirteenth embodiment of the present invention. Reference numeral 39 designates a conductive pipe which is placed within a cylinder composed of the two-wire helical antenna 30 shown in FIG. 1. As shown in FIG. 8, the coaxial lines 25, 35 are disposed inside the conductive pipe 39. In the first embodiment, because two coaxial lines 25, 35 are disposed inside the two-wire helical antenna 30, the two-wire helical antenna 30 loses the axial symmetry of the construction. Thus, a problem originated from this fact is that the shape of the radiation pattern of beam radiated from the two-wire helical antenna 30 into space is not axially symmetrical relative to the axis of the two-wire helical antenna 30. However, in the case in which the conductive pipe 39 is used, the coaxial lines 25, 35 are shielded within the conductive pipe 39, so that the shape of the antenna composed of the two-wire helical antenna 30 and the conductive pipe 39 is axially symmetrical. Consequently, the axial symmetry of the radiation pattern can be maintained.

Embodiment 14

In the thirteenth embodiment, although the conductive pipe 39 is disposed within only the two-wire helical antenna 30, it is permissible to dispose the conductive pipes 39 within both the two-wire helical antenna 20 and the two-wire helical antenna 30. In this case also, the axial symmetry of the radiation pattern can be maintained.

Embodiment 15

As the conductive pipe 39 according to the aforementioned embodiments 13, 14, it is possible to use a metallic pipe, a tube formed with metallic strands or a dielectric cylinder which is plated with metal or on which metal is deposited. In any case also, the axial symmetry of the radiation pattern can be maintained.

Embodiment 16

Figure 10A:
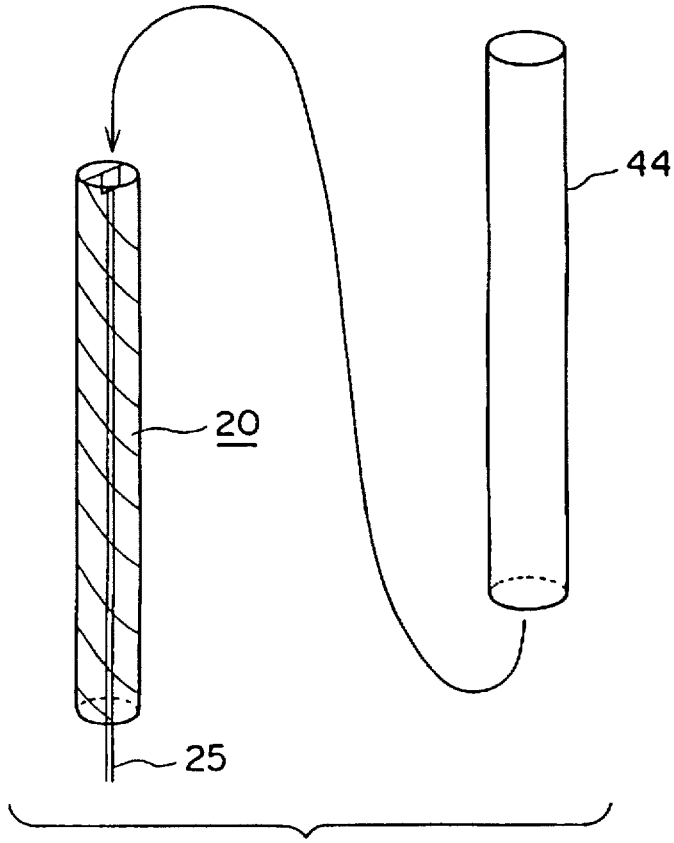
FIGS. 10*a*, 10*b* are construction drawings of the antenna apparatus according to the sixteenth embodiment of the present invention.
Figure 10B:
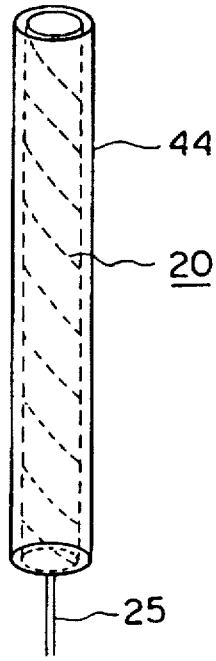

FIG. 10 is a construction drawing of the antenna apparatus according to the sixteenth embodiment of the present invention. Reference numeral 20 designates the same two-wire helical antenna as that according the first embodiment shown in FIG. 1. Numeral 44 designates a cylindrical dielectric radome for covering the two-wire helical antenna 20 on use.

According to such a construction, it is possible to prepare a plurality of the dielectric radomes made of dielectric materials having different dielectric constants, and use one of them depending on the purpose for use. When the dielectric radome 44 is placed around the two-wire helical antenna 20 for use, the wavelengths of signal currents flowing on the conductive wires 22*a*, 22*b* composed of the two-wire helical antenna 20 change depending the dielectric constant of the dielectric radome 44. Thus, by using one of a plurality of the dielectric radomes 44 having different dielectric constants, it is possible to change the radiation direction of the conical beam 7 within a plane including the axis of the two-wire helical antenna 20.

Embodiment 17

Figure 11:
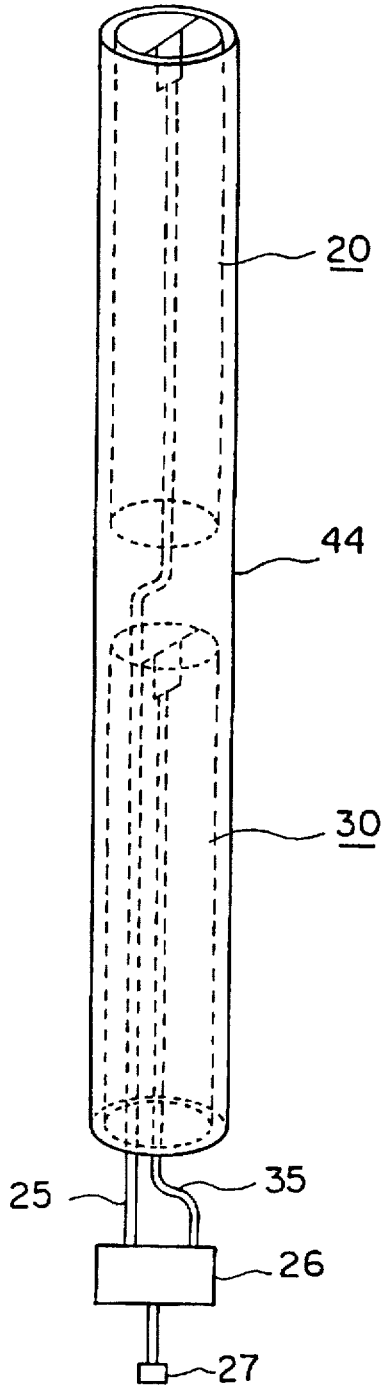
FIG. 11 is a construction drawing of the antenna apparatus according to the seventeenth embodiment of the present invention.

FIG. 11 is a construction drawing of the antenna apparatus according to the seventeenth embodiment of the present invention. Referring to the same Figure, reference numeral 44 designates the cylindrical radome which is placed around the antenna apparatus according to the first embodiment shown in FIG. 1.

According to the aforementioned construction, it is possible to prepare a plurality of the dielectric radome 44 having different dielectric constants and use one of them. In this case also, it is possible to change the radiation direction of beam radiated from the two-wire helical antennas 20, 30 into space within the plane including the axis of the two-wire helical antennas 20, 30.

Embodiment 18

Figure 12:
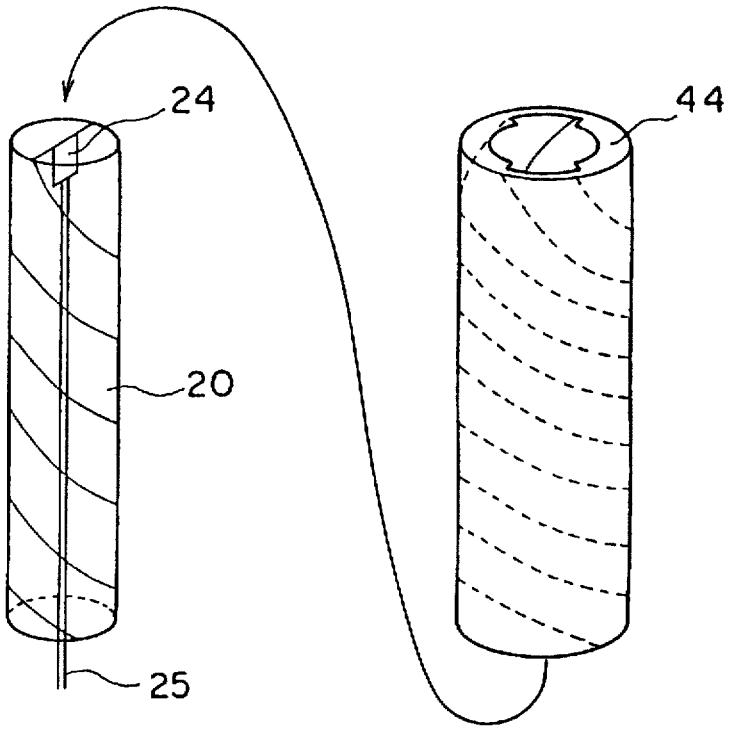
FIG. 12 is a construction drawing of the antenna apparatus according to the eighteenth embodiment of the present invention.
Figure 13:
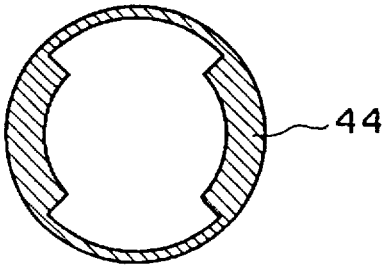
FIG. 13 is a sectional view of the dielectric radome shown in FIG. 12.

FIG. 12 is a construction drawing of the antenna apparatus according to the eighteenth embodiment of the present invention. Referring to the same Figure, reference numeral 20 designates the same two-wire helical antenna as shown in FIG. 1. Numeral 44 designates a dielectric radome in which the thickness of the dielectric is changed in the form of internal thread at substantially the same intervals as those of the conductive wires 22*a*, 22*b* constituting the two-wire helical antenna 20. The dielectric radome 44 is placed around the two-wire helical antenna 20 as in the aforementioned respective embodiments. FIG. 13 is a sectional view of the dielectric radome 44.

If the portions of dielectric having larger thickness of the dielectric radome 44 are located on the conductive wires 22*a*, 22*b*, the wavelengths of signal currents flowing on the conductive wires 22*a*, 22*b* are reduced due to the effect of the dielectric. Thus, the direction of the radiation of the conical beam radiated from the two-wire helical antenna 20 into space comes near a right angle with respect to the axis of the two-wire helical antenna 20.

On the other hand, if the portions of the dielectric having smaller thickness of the dielectric radome 44 are located on the conductive wires 22*a*, 22*b*, the effect of the dielectric is reduced so that the wavelengths of the signal currents flowing on the conductive wires 22*a*, 22*b* are not reduced. Thus, the direction of the radiation of the conical beam radiated from the two-wire helical antenna 20 into space comes near the axis of the two-wire helical antenna 20.

Namely, it is possible to control the radiation direction of the conical beam 7 by changing the way in which the two-wire helical antenna 20 is located on the dielectric radome 44.

Embodiment 19

Figures 15A, 15B:
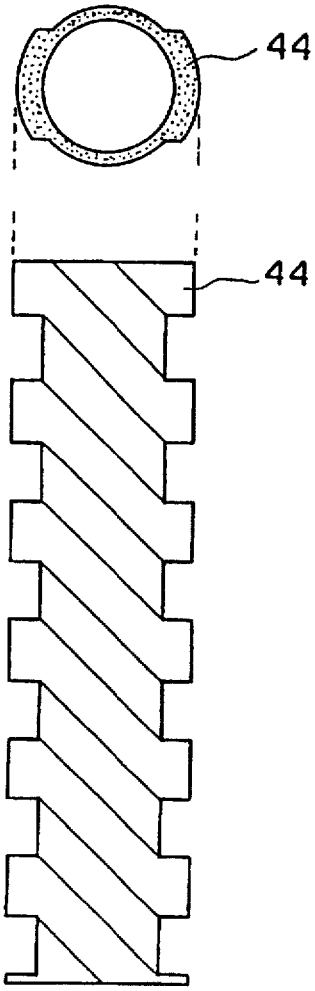
FIG. 15 is a construction drawing of the dielectric radome shown in FIG. 13.

Although, in the eighteenth embodiment, the thickness of the dielectric of the dielectric radome 44 is changed in the form of internal thread, it is permissible to change the thickness of the dielectric of the dielectric radome 44 in the form of external thread as shown in FIG. 15. In this case also, it is possible to control the radiation direction of the conical beam 7 by changing the way in which the two-wire helical antenna 20 is located on the dielectric radome 44.

Embodiment 20

Figure 16:
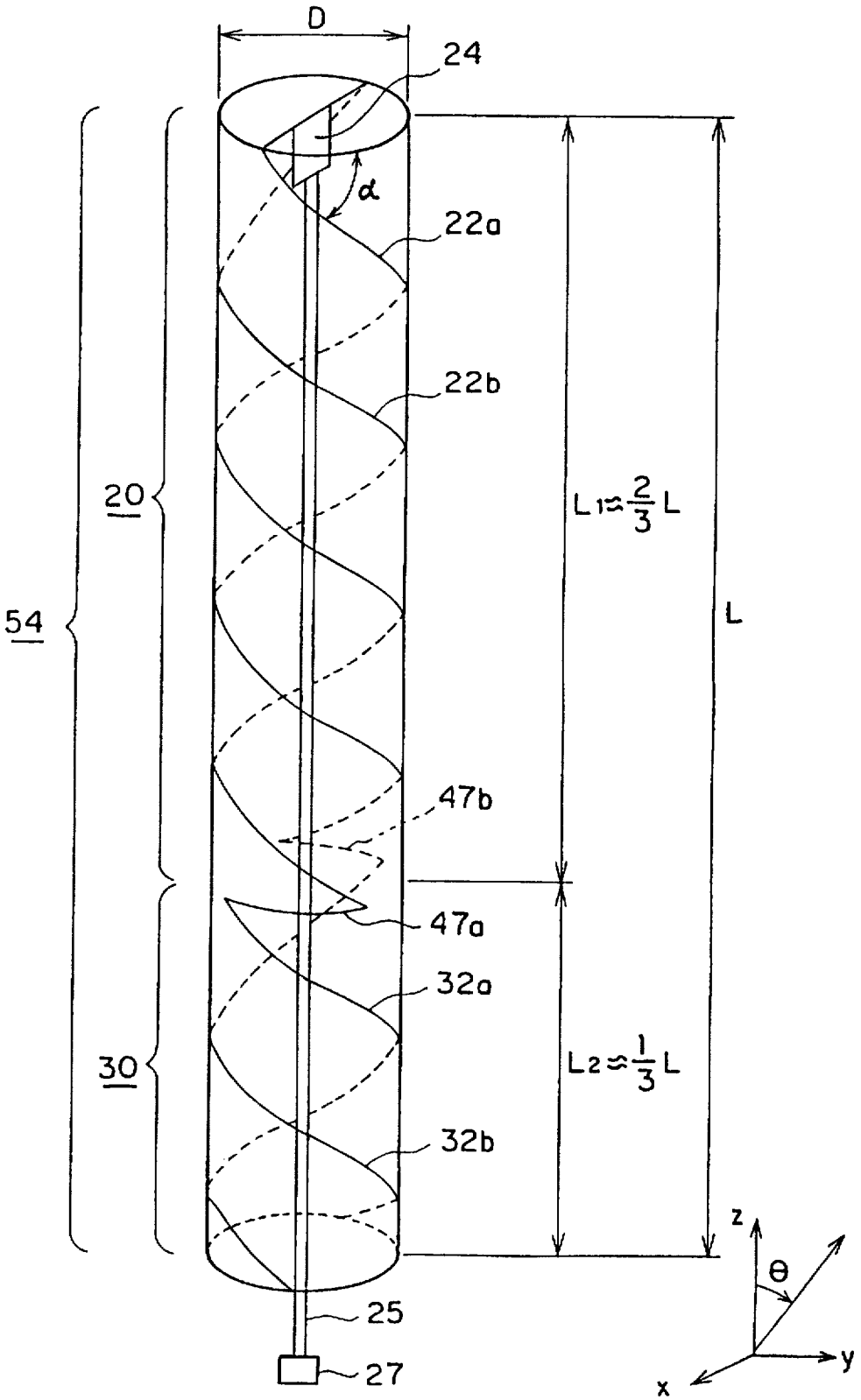
FIG. 16 is a construction drawing of the antenna apparatus according to the twentieth embodiment of the present invention.

FIG. 16 is a construction drawing of the antenna apparatus according to the twentieth embodiment of the present invention. Referring to the same Figure, reference numerals 22*a*, 22*b*, 32*a*, 32*b* designate conductive wires wound around a cylinder having the diameter of D at the pitch angle $\alpha$. Numeral 24 designates the balanced-to-unbalanced converter connected to the conductive wires 22*a*, 22*b*. Numeral 25 designates the coaxial line. Numeral 27 designates the input/output terminal. Numerals 47*a*, 47*b* designate delay lines having the same length, disposed on the circumference of the cylinder having the diameter of D so that the delay lines 47*a*, 47*b* face each other across the cylinder, in order to achieve a phase changing means. The delay line 47*a* is connected to the conductive wires 22*a*, 32*a* and the delay line 47*b* is connected to the conductive wires 22*b*, 32*b*.

Thus, as for the construction of this antenna apparatus, the two-wire helical antenna 30 having the length of L2 composed of the conductive wires 32*a*, 32*b* is connected to the terminal of the two-wire helical antenna 20 having the length of L1 composed of the conductive wires 22*a*, 22*b* through the circular delay lines 47*a*, 47*b* which diameters are nearly same as those of the helical antennas so that the axes thereof substantially coincide with each other. This antenna apparatus is called twin-peak beam two-wire helical antenna 54 for convenience. The length L1 of the two-wire helical antenna 20 is assumed to be approximately ⅔ the overall length L of the twin-peak beam two-wire helical antenna 54 and the length L2 of the two-wire helical antenna 30 is assumed to be approximately ⅓ the overall length of the twin-peak beam two-wire helical antenna 54. The lengths of the delay lines 47*a*, 47*b* are set such that the sum of the amount of the phase delay by the delay lines 47*a*, 47*b* and the angle $\beta$ of circular of each delay line 47*a*, 47*b* is approximately 180° ($\beta$ is shown in FIG. 16).

Figure 17A:
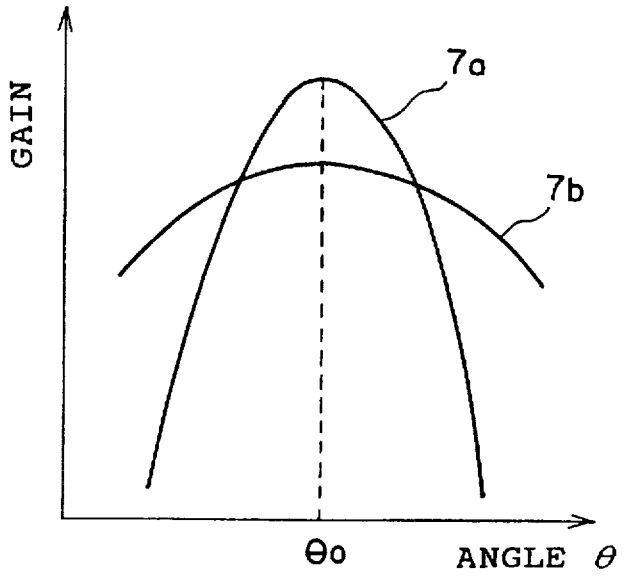
FIGS. 17*a*, 17*b* are diagrams showing the synthesization of twin-peak conical beam.
Figure 17B:
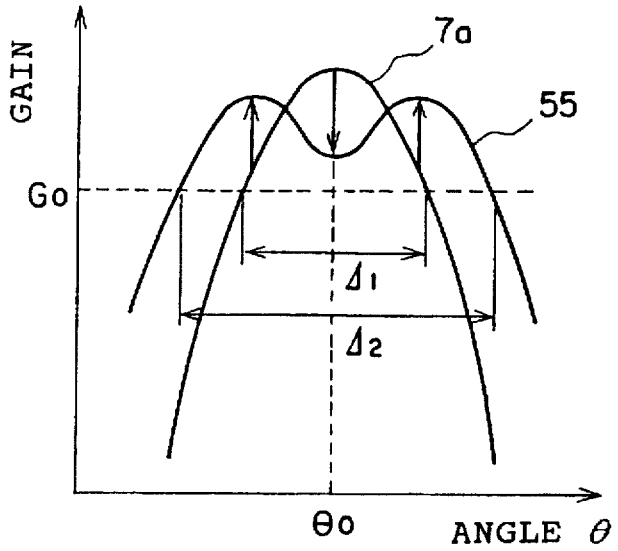

The beam from the two-wire helical antenna 20 is the conical beam 7*a* directed at the angle $\theta 0$ (the angles $\theta$, $\theta 0$ in FIGS. 17*a*, 17*b* designate an angle from the z-axis as shown in FIG. 16). The beam from the two-wire helical antenna 30 is the conical beam 7*b* directed at the angle $\theta 0$. Because the length L2 of the two-wire helical antenna 30 is approximately half of the length L1 of the two-wire helical antenna 20, the width of the conical beam 7*b* is wider than that of the conical beam 7*a*. Further, the phase value (phase radiation pattern) along the angle $\theta 0$ of the conical beam 7*b* differs from the phase value along the angle $\theta 0$ of the conical beam 7*a* by approximately 180°. The reasons are that, because as described above, the two-wire helical antenna 30 is rotated with respect to the two-wire helical antenna 20, a change of the phase corresponding to this rotary angle occurs in the conical beam 7b as in the embodiment 10 and the phase of signal fed to the two-wire helical antenna 30 is delayed by the delay lines 47a, 47b by the length thereof.

By synthesizing the two conical beams 7a, 7b, beam (synthesized beam 55) radiated from the twin-peak beam twowire helical antenna 54 is obtained. FIG. 17b shows the condition of the synthesizing. In the direction along the angle θ0, the gain of the synthesized beam 55 is lower than that of the conical beam 7a because the phases of the conical beams 7a, 7b differ by approximately 180°. On the other hand, because the positions in which the two-wire helical antenna 20 and the two-wire helical antenna 30 are placed are different from each other, the changes of the phases of the conical beams 7a, 7b relative to the angle θ are different. Thus, in the direction in which the angle θ is different from the angle θ0, the difference of the phase between the conical beams 7a and 7b is not as same as 180°. Namely, there appear such angles in which the sum of the levels of the conical beams 7a, 7b is not zero. Thus, the synthesized beam 55 becomes twin-peak conical beam within a plane including the z-axis.

As shown in FIG. 17b, assuming that a required gain is G0, the angle range where the gain is over G0 is Δ1 by the conical beam 7a and on the other hand, the angle range under the gain over G0 is Δ2 which is larger than Δ1 by the synthesized beam 55.

Meanwhile, although the position in which the phase changing means is to be inserted is such a position which divides the helical antenna by 2:1 according to the present embodiment, the present embodiment is not limited to this position, but the requirement of the present embodiment can be satisfied if the insertion position is located at a position farther than ½ the overall length of the helical antenna from the feed terminals for the conductive wires of the helical antenna. By setting the excitation condition appropriately, an antenna apparatus which achieves the same effect as when the insertion position is located at a position which is ½ the overall length can be obtained.

Embodiment 21

Figure 18A:
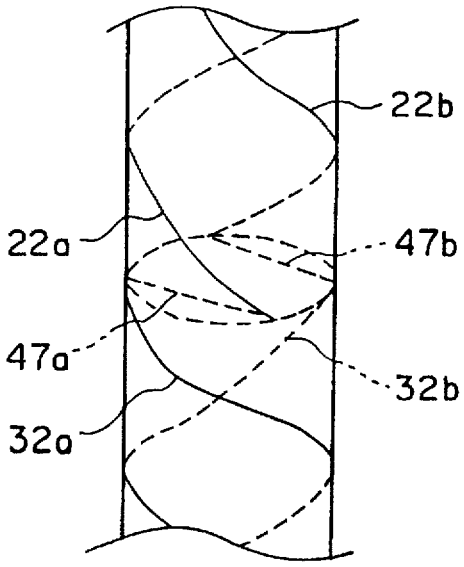
FIGS. 18*a*–18*c* are construction drawings of the antenna apparatus according to the twenty first embodiment of the present invention.
Figure 18B:
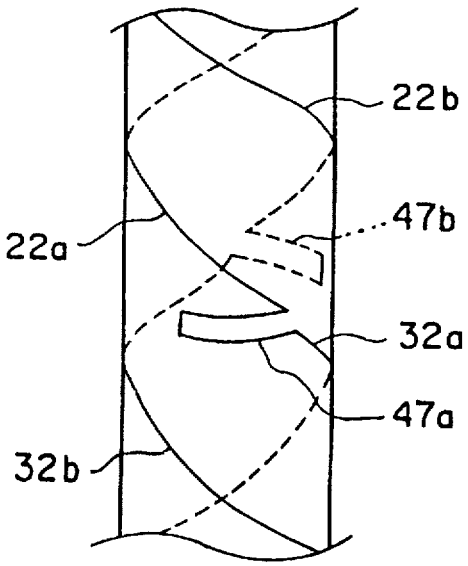
Figure 18C:
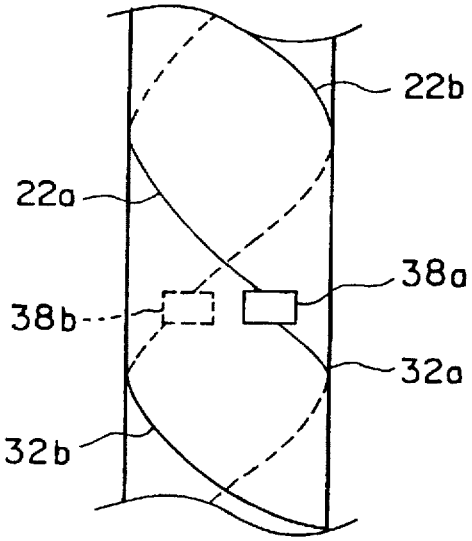

Although, according to the twentieth embodiment, the delay lines 47a, 47b disposed on the circumference having the diameter D are used as the phase changing means, it is permissible to dispose the delay lines 47a, 48b substantially along the circumference of a circle having the diameter D as shown in FIG. 18a or form lines which are bent as shown in FIG. 18b. In either case also, the synthesized beam 55 can be twin-peak conical beam, so that the range of the angle θ which can be covered under the required gain G0 can be expanded. Further, by connecting the phase control devices 38a, 38b shown in the seventh embodiment to the conductive wires 22a, 22b and the conductive wires 32a, 32b respectively, as shown in FIG. 18c, it is possible to form the synthesized beam 55 in the form of twin-peak conical beam, so that the range of the angle θ which can be covered by the required gain G0 can be expanded.

Embodiment 22

Although, the two-wire helical antennas 20, 30 composed of two conductive wires 22a, 22b and 32a, 33b respectively are used in the twentieth embodiment, it is permissible to use a single-wire helical antenna which is wound with a conductive wire at the pitch angle α or a multiple-wire helical antenna which is wound with three or more conductive wires at equal intervals with the pitch angle α. In either case also, it is possible to form the synthesized beam 55 in the form of twin-peak conical beam so as to expand the range of the angle θ which can be covered by the required gain G0.

Embodiment 23

Figure 19:
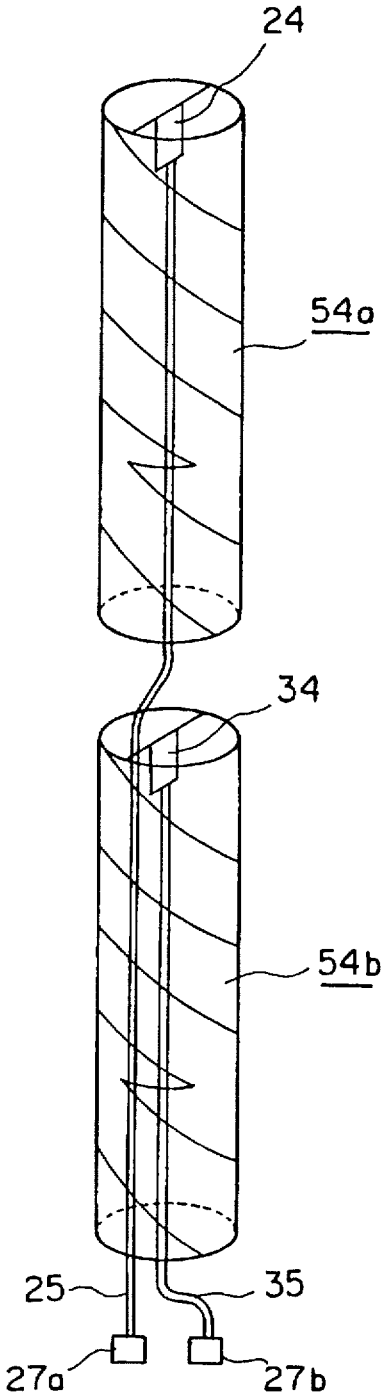
FIG. 19 is a construction drawing of the antenna apparatus according to the twenty third embodiment of the present invention.

FIG. 19 is a construction drawing of the antenna apparatus according to the twenty third embodiment of the present invention. In this antenna apparatus, a twin-peak beam two-wire helical antenna 54a is composed of two conductive wires wound at a specified pitch angle α1. A twin-peak beam two-wire helical antenna 54b is composed of two conductive wires wound at a specified pitch angle α2 which is different from the pitch angle α1 of the twin-peak beam two-wire helical antenna 54a. The two twin-peak beam two-wire helical antennas 54a, 54b are disposed along the length thereof so that the axes of the twin-peak beam two-wire helical antennas 54a, 54b substantially coincide with each other. Reference numerals 24, 34 designate balanced-to-unbalanced converters which are connected to respective wires of the twin-peak beam two-wire helical antennas 54a, 54b and which are placed within the twin-peak beam two-wire helical antennas 54a, 54b. Numerals 25, 35 designate coaxial lines which are connected to the balanced-to-unbalanced converters 24, 34 respectively and which are disposed within the twin-peak beam two-wire helical antennas 54a, 54b. Numeral 27a designates a transmission signal terminal for sending transmission signals to the coaxial line 25 and numeral 27b designates a reception signal terminal for receiving reception signals from the coaxial line 35.

Then, the operation of the antenna apparatus according to the present embodiment will be described. Feeding means is provided so as to send a transmission signal to one of the twin-peak beam two-wire helical antenna 54a and receive a reception signal from the other twin-peak beam two-wire helical antenna 54b. By using the two twin-peak beam two-wire helical antennas 54a, 54b specifically for sending and reception of signals respectively, it is possible to equalize the radiation direction of the twin-peak shape even if the frequencies of the transmission signals and reception signals differ from each other.

Although the two-wire helical antenna is described above, the helical antenna is not limited to the aforementioned description. Further, it is permissible to use either of the helical antennas as the signal sending antenna.

Embodiment 24

Figure 20:
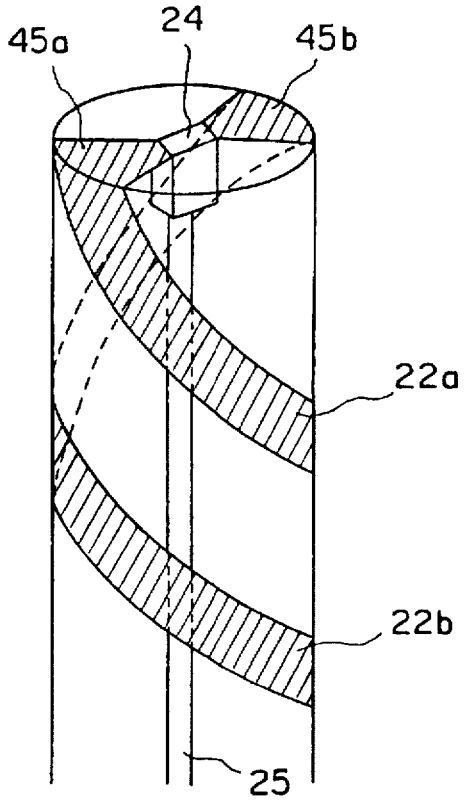
FIG. 20 is a construction drawing of the antenna apparatus according to the twenty fourth embodiment of the present invention.

FIG. 20 is a construction drawing of the antenna apparatus according to the twenty fourth embodiment of the present invention. Reference numerals 22a, 22b designate the conductive wires and numeral 24 designates the balanced-to-unbalanced converter. Numeral 45a designates a fan-shaped connecting line for connecting the conductive line 22a to the balanced-to-unbalanced converter 24. Numeral 45b designates a fan-shaped connecting line for connecting the conductive wire 22b to the balanced-to-unbalanced converter 24. Because the connecting lines 45a, 45b are regarded as inductance, the input impedance from the balanced-to-unbalanced converter 24 of the two-wire helical antenna 20 composed of the conductive wires 22a, 22b becomes inductive. In the present embodiment, by forming the shape of the connecting lines 45a, 45b in the fan-shape, the inductance of the connecting lines 45a, 45b is reduced thereby facilitating the matching of the input impedance of the two-wire helical antenna 20. Additionally, forming the shape of the connecting lines 45*a*, 45*b* in the fan-shape can enhance the mechanical strength of the connecting lines 45*a*, 45*b*.

Embodiment 25

Figure 21A:
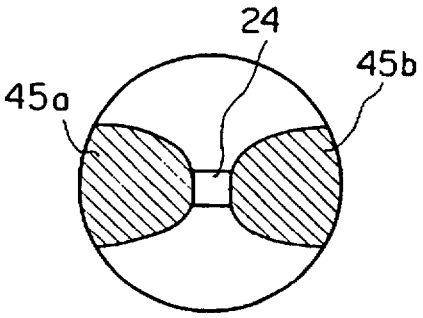
FIGS. 21*a*–21*d* are drawings for explaining the external shapes of the respective connecting lines.
Figure 21B:
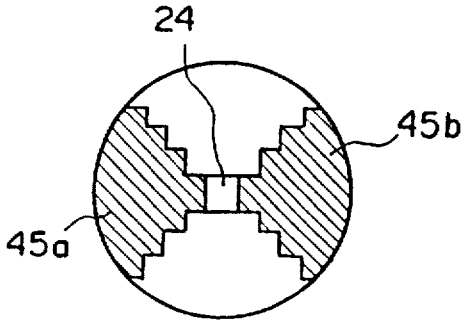
Figure 21C:
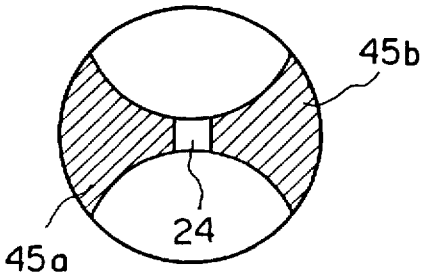
Figure 21D:
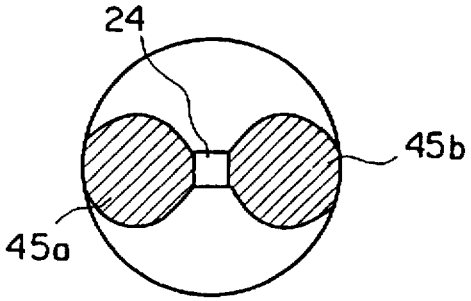

Although the shape of the connecting lines 45*a*, 45*b* is fan-shaped in the twenty fourth embodiment, the shape thereof may be of shapes in which the width of the connecting line changes gradually as shown in FIGS. 21–21*d*. In this case also, it is possible to obtain such an effect that matching of the input impedance of the two-wire helical antenna 20 is facilitated.

Embodiment 26

Figure 22:
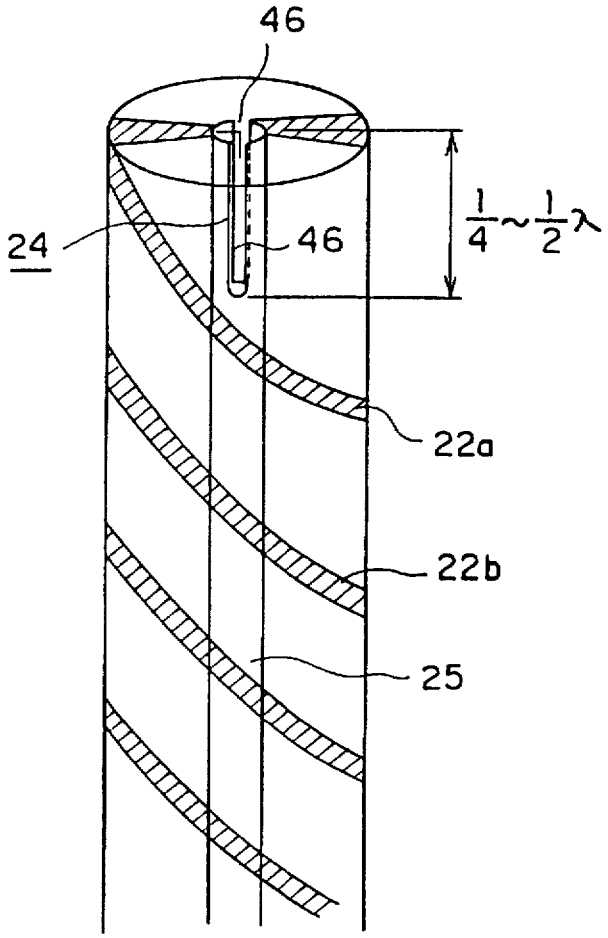
FIG. 22 is a construction drawing of the antenna apparatus according to the twenty sixth embodiment of the present invention.

FIG. 22 is a construction drawing of the antenna apparatus according to the twenty sixth embodiment of the present invention. Instead of the balanced-to-unbalanced converter 24 according to the twenty fourth embodiment, a so-called split coaxial type balun is used in which slits 46 are formed on both sides of an external conductor at the end of the coaxial line 25 and the central conductor of the coaxial line 25 is connected to the external conductor. The length of the slit 46 is set to be electrically ¼ to ½ the wavelength. As shown in the twenty fourth embodiment, generally, the input impedance of the two-wire helical antenna 20 composed of the conductive wires 22*a*, 22*b* becomes inductive. However, in the present embodiment, by setting the length of the slit 46 to electrically ¼ to ½ the wavelength and making the balanced-to-unbalanced converter 24 capacitive, the inductance of the input impedance is eliminated thereby facilitating the matching of the input impedance.

In the present embodiment, the conductive wire is not limited to a wire but may be a strip conductor or the like.

Embodiment 27

Figure 23:
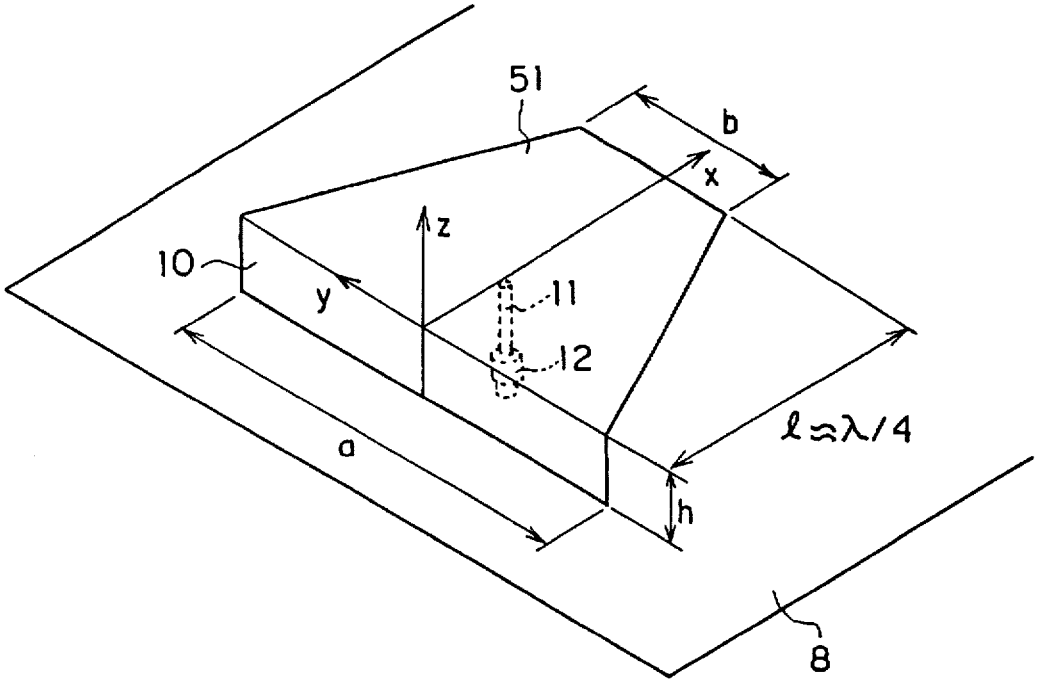
FIG. 23 is a construction drawing of the antenna apparatus according to the twenty seventh embodiment of the present invention.

FIG. 23 is a perspective view of the antenna apparatus according to the twenty seventh embodiment of the present invention. Reference numeral 8 designates a conductive ground plate and numeral 51 designates an isosceles trapezoid conductive plate having the lower bottom of length a, the upper bottom of length b and the height of l, placed in parallel to the conductive ground plate 8 at a position apart from the conductive ground plate 8 by the distance h. Numeral 11 designates a feeding conductive probe which is placed between the conductive plate 51 and the conductive ground plate 8 and which is connected to the conductive plate 51 and numeral 12 designates an input/output connector which is connected to the feeding conductive probe and which is placed on the conductive ground plate 8 on the opposite side to the side in which the conductive plate 51 is placed.

Generally, the distance h is determined to be electrically approximately 1/100 to 5/100 the wavelength and the height l of the trapezoid is determined to be electrically approximately ¼ the wavelength.

Signal input from the input/output connector 12 is supplied to the one-side shortcircuit type micro-strip antenna composed of the conductive ground plate 8, the conductive plate 51 and the grounding conductive plate 10 through the feeding conductive probe and irradiated into space as in conventional examples. Radiation of signals from the one-side shortcircuit type micro-strip antenna can be considered to be radiation from in-phase magnetic currents M1a, M1b, M2, M3a, M3b placed on three sides not connected to the grounding conductive plate 10, of the four sides of the conductive plate 51.

Figure 24:
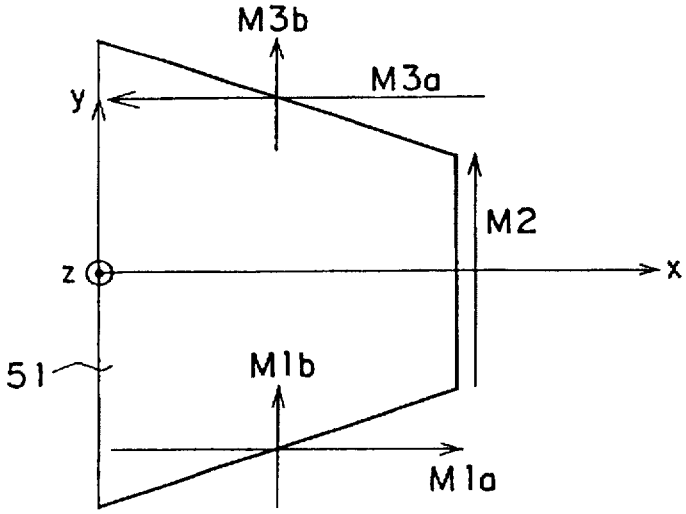
FIG. 24 is a diagram showing magnetic currents of the antenna apparatus shown in FIG. 23.

Considering the plane yz shown in FIG. 24, the radiation electric field from the magnetic currents M1a, M3a and the radiation electric field from the magnetic currents M1b, M2, M3b are in such condition that the polarizations are perpendicular to each other and that the phases thereof are different by 90°. Thus, the radiation from the one-side shortcircuit type micro-strip antenna into the plane yz becomes elliptic polarization.

Figure 25:
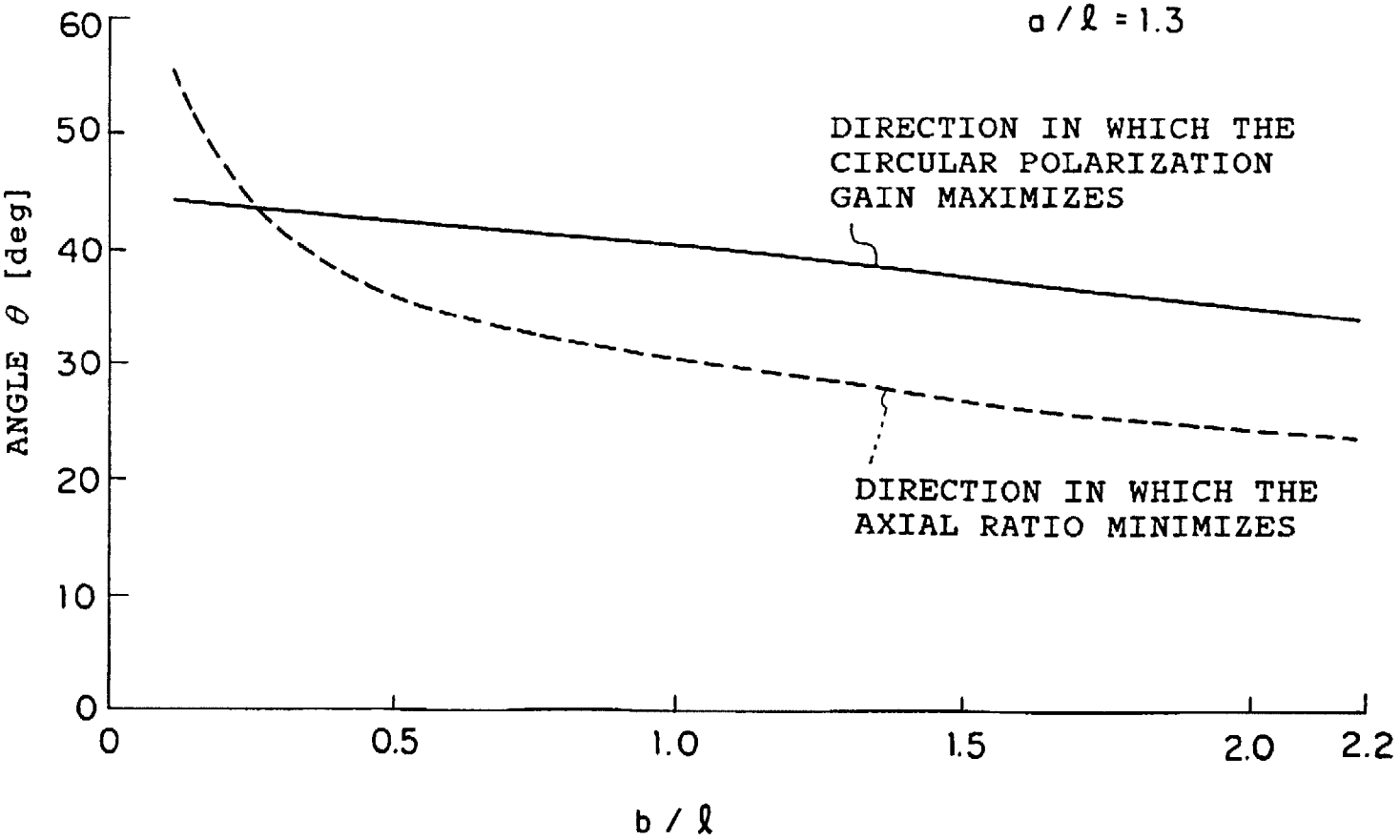
FIG. 25 is a diagram showing the characteristics of the antenna apparatus shown in FIG. 23.

Then, if the width b of the upper bottom of the conductive plate 51 is changed, the magnitudes of the magnetic currents M1a, M1b, M2, M3a, M3b are changed. Thus, as shown in FIG. 25, it is possible to change the angle in which the circular polarization gain maximizes (the angle θ designates an angle from the z-axis) and the angle in which the axial ratio minimizes. Because the width a of the lower bottom of the conductive plate 51 grounded to the conductive ground plate 8 is constant, the input impedance characteristic of the one-side shortcircuit type micro-strip antenna changes little. Referring to FIG. 25, the real line indicates the direction in which the circular polarization gain maximizes and the broken line indicates the direction in which the axial ratio minimizes.

Embodiment 28

Figure 26:
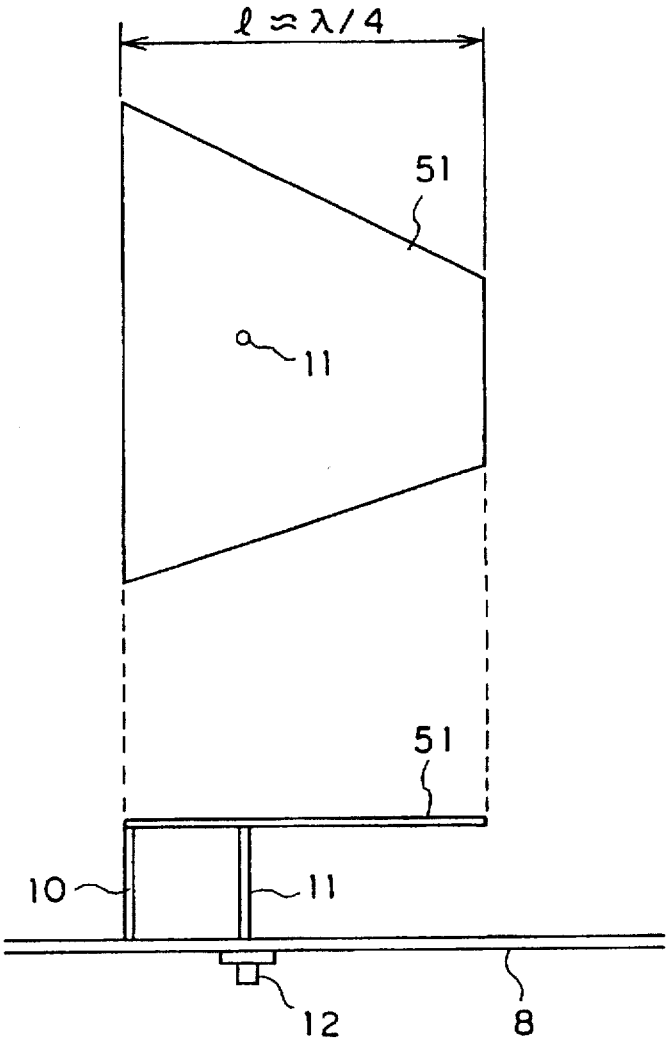
FIG. 26 is a construction drawing of the antenna apparatus according to the twenty eighth embodiment of the present invention.

Although the shape of the conductive plate 51 is isosceles trapezoid in the twenty seventh embodiment, even in the case of non-isosceles trapezoid as shown in FIG. 26, it is possible to change the angle in which the circular polarization gain maximizes and the angle in which the axial ratio minimizes without changing the input impedance characteristic so much.

Embodiment 29

Figure 27:
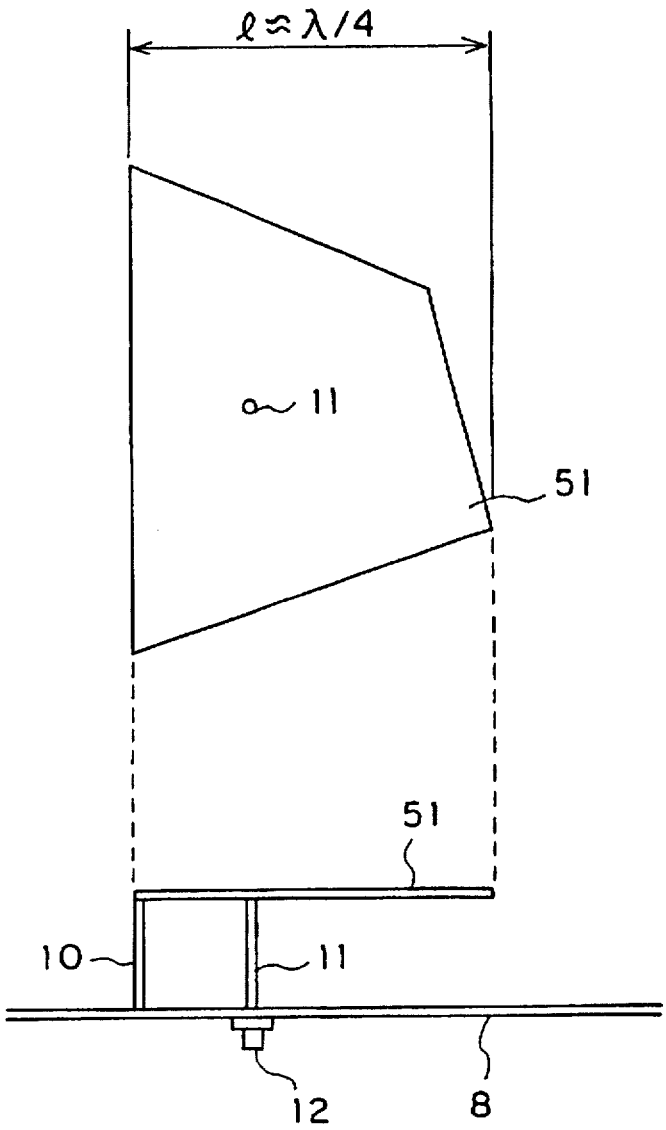
FIG. 27 is a construction drawing of the antenna apparatus according to the twenty ninth embodiment of the present invention.

In the case in which the shape of the conductive plate 51 is a tetragon which is not trapezoid, as shown in FIG. 27 and the length l from the side of the conductive plate 51 connected to the grounding conductive plate 10 to the apex facing this side is determined so as to be electrically approximately ¼ the wavelength, it is also possible to change the direction in which the circular polarization gain maximizes and the angle in which the axial ratio minimizes without changing the input impedance characteristic so much.

Embodiment 30

Figure 28:
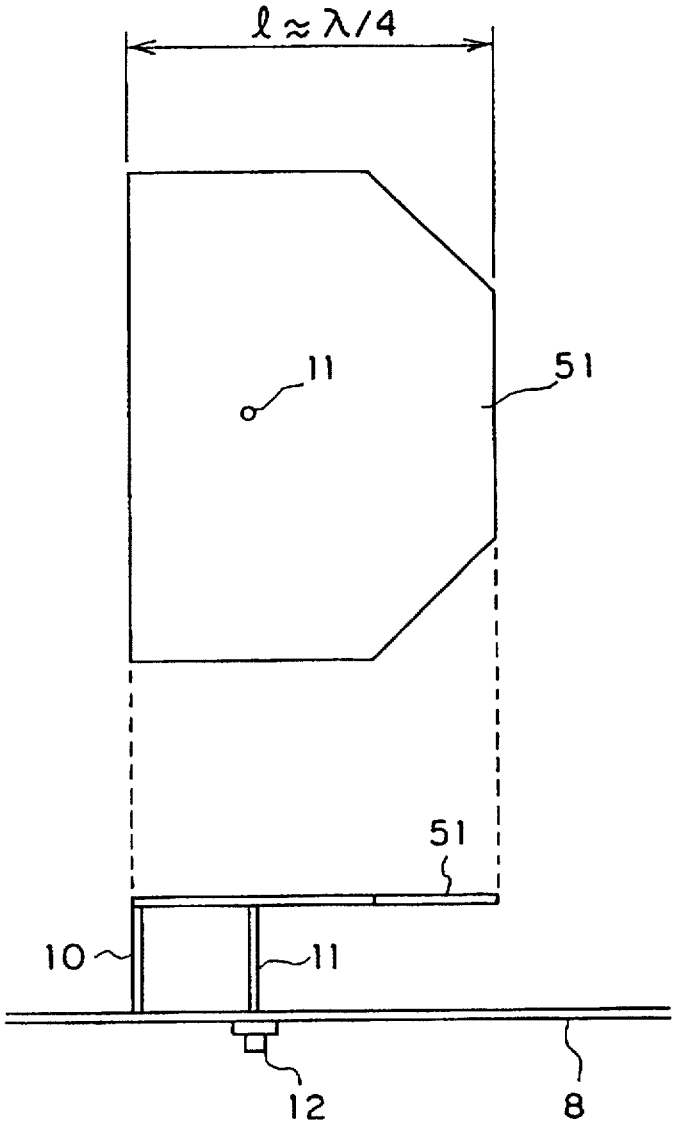
FIG. 28 is a construction drawing of the antenna apparatus according to the thirtieth embodiment of the present invention.

In the case in which the shape of the conductive plate 51 is a polygon, as shown in FIG. 28 and the length l from the side of the conductive plate 51 connected to the grounding conductive plate 10 to the apex or side facing this side is determined so as to be electrically approximately ¼ the wavelength, it is also possible to change the direction in which the circular polarization gain maximizes and the angle in which the axial ratio minimizes without changing the input impedance characteristic so much.

Embodiment 31

Figure 29:
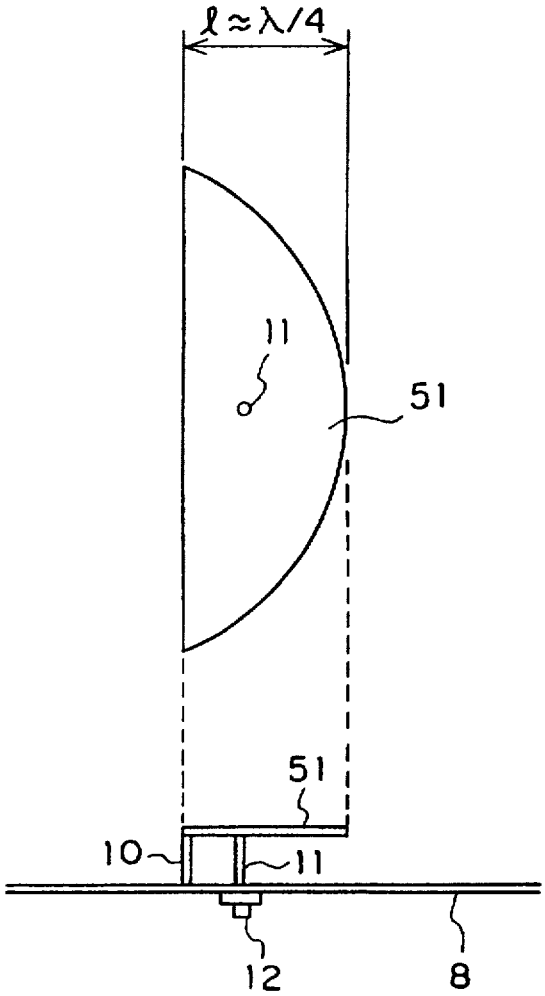
FIG. 29 is a construction drawing of the antenna apparatus according to the thirty first embodiment of the present invention.

In the case in which the shape of the conductive plate 51 is a partial ellipse, as shown in FIG. 29 and the length l from the side of the conductive plate 51 connected to the grounding conductive plate 10 to a point of the partial ellipse facing this side is determined so as to be electrically approximately ¼ the wavelength, it is also possible to change the direction in which the circular polarization gain maximizes and the angle in which the axial ratio minimizes without changing the input impedance characteristic so much.

Embodiment 32

Figure 30:
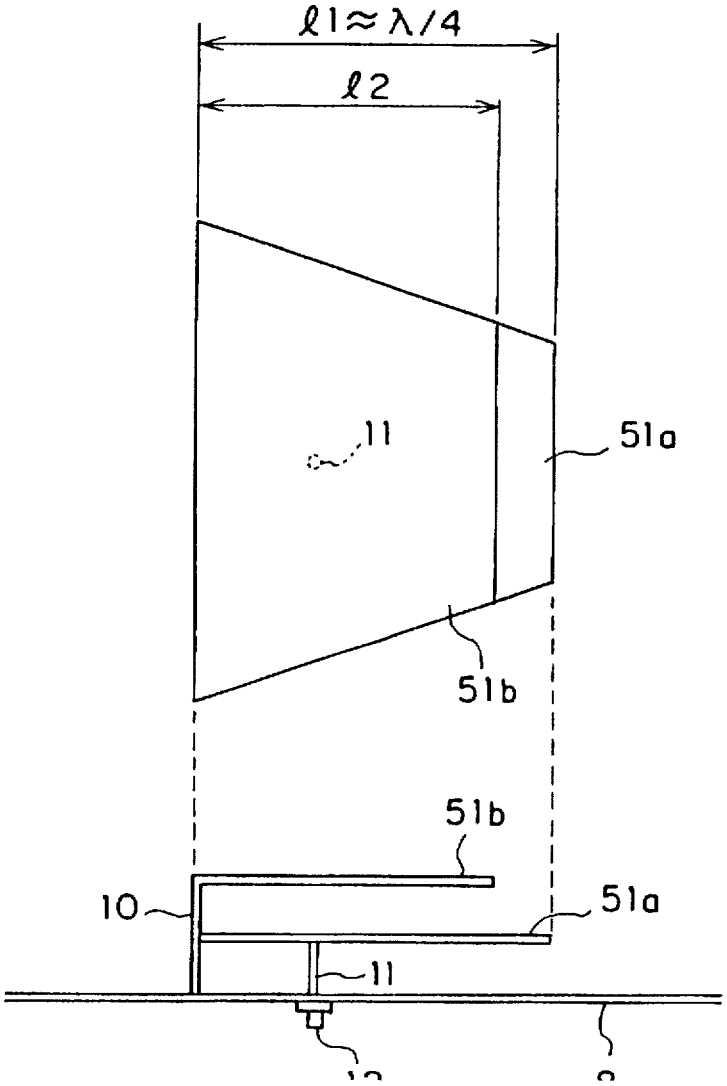
FIG. 30 is a construction drawing of the antenna apparatus according to the thirty second embodiment of the present invention.

FIG. 30 is a construction drawing of the antenna apparatus according to the thirty second embodiment of the present invention. Referring to the same Figure, reference numeral 8 designates a conductive ground plate and numeral 51*a* designates an isosceles trapezoid conductive plate having the lower bottom of length a, the upper bottom of length b and the height l1, which is placed at a position apart from the conductive ground plate 8 by the distance h1 in parallel to the conductive ground plate 8. Numeral 51*b* designates an isosceles trapezoid conductive plate having the lower bottom of length a, the upper bottom of length c and the height l2, which is placed at a position apart from the conductive plate 51*a* by the distance h2 in parallel to the conductive ground plate 8.

The lower bottom of the conductive plate 51*a* overlaps the lower bottom of the conductive plate 51*b*. Numeral 10 designates a grounding conductive plate which connects the lower bottoms of the conductive plates 51*a*, 51*b* to the conductive ground plate 8. Numeral 11 designates a feeding conductive probe which is placed between the conductive plate 51*a* and the conductive ground plate 8 and which is connected to the conductive plate 51*a*. Numeral 12 designates an input/output connector which is connected to the feeding conductive probe and placed on an opposite side to the side in which the conductive plate 51*a* is placed, of the conductive ground plate 8.

Generally, the aforementioned distances h1, h2 are determined so as to be electrically 1/100 to 5/100 the wavelength and the heights l1, l2 of the trapezoids are determined so as to be electrically 1/4 the wavelength. Additionally, generally l2 is determined so as to be smaller than l1.

Signal input from the input/output connector 12 is supplied to the one-side shortcircuit type micro-strip antenna composed of the conductive ground plate 8, the conductive plate 51*a* and the grounding conductive plate 10 through the feeding conductive probe 11 and radiated into space. The radiated signal is coupled to the non-excited one-side shortcircuit type micro-strip antenna composed of the grounding conductive plate 10 and the conductive plate 51*b* and signal is also radiated from this non-excited one-side shortcircuit type micro-strip antenna. In this case also, by changing the width b of the upper bottom of the conductive plate 51*a* and the width c of the upper bottom of the conductive plate 51*b*, it is possible to change the angle in which the circular polarization gain maximizes and the angle in which the axial ratio minimizes without changing the input impedance so much. Additionally, by using the two one-side shortcircuit type micro-strip antennas in coupling, the change of the input impedance is reduced so that the band of the frequency in use can be expanded.

Embodiment 33

Figure 31B:
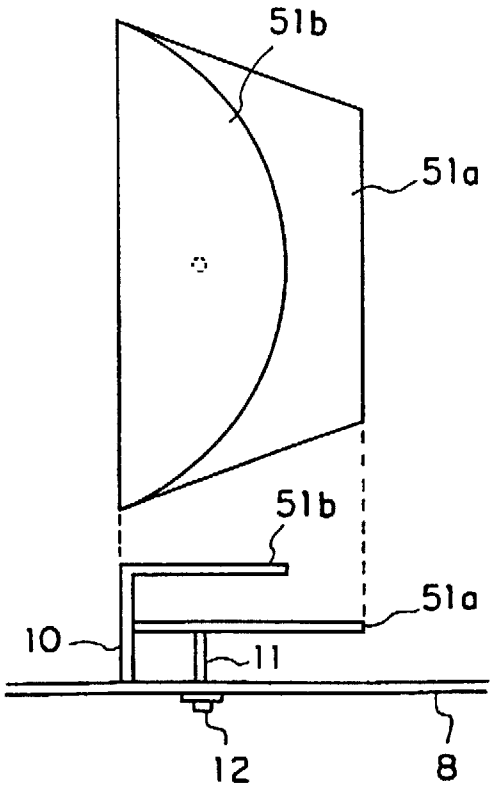
FIGS. 31*a*–31*b* are construction drawings of the antenna apparatuses according to the thirty third embodiment of the present invention.
Figure 31A:
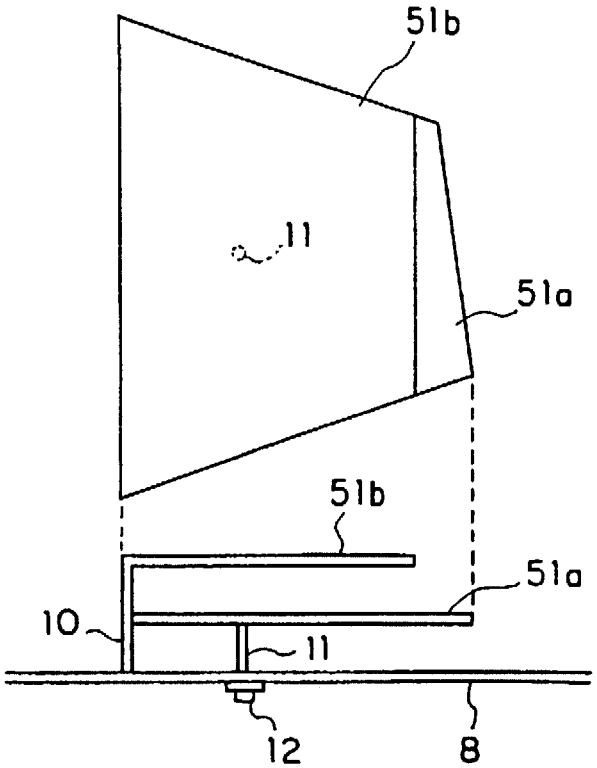

If the shape of the conductive plates 51*a*, 51*b* is formed so as to be polygon or partially elliptic as shown in FIGS. 31*a*, 31*b*, it is possible to change the angle in which the circular polarization gain maximizes and the angle in which the axial ratio minimizes without changing the input impedance characteristic so much.

Further, even if the shapes of the conductive plates 51*a* and 51*b* are different from each other, it is possible to change the angle in which the circular polarization gain maximizes and the angle in which the axial ratio minimizes.

Embodiment 34

Figure 32:
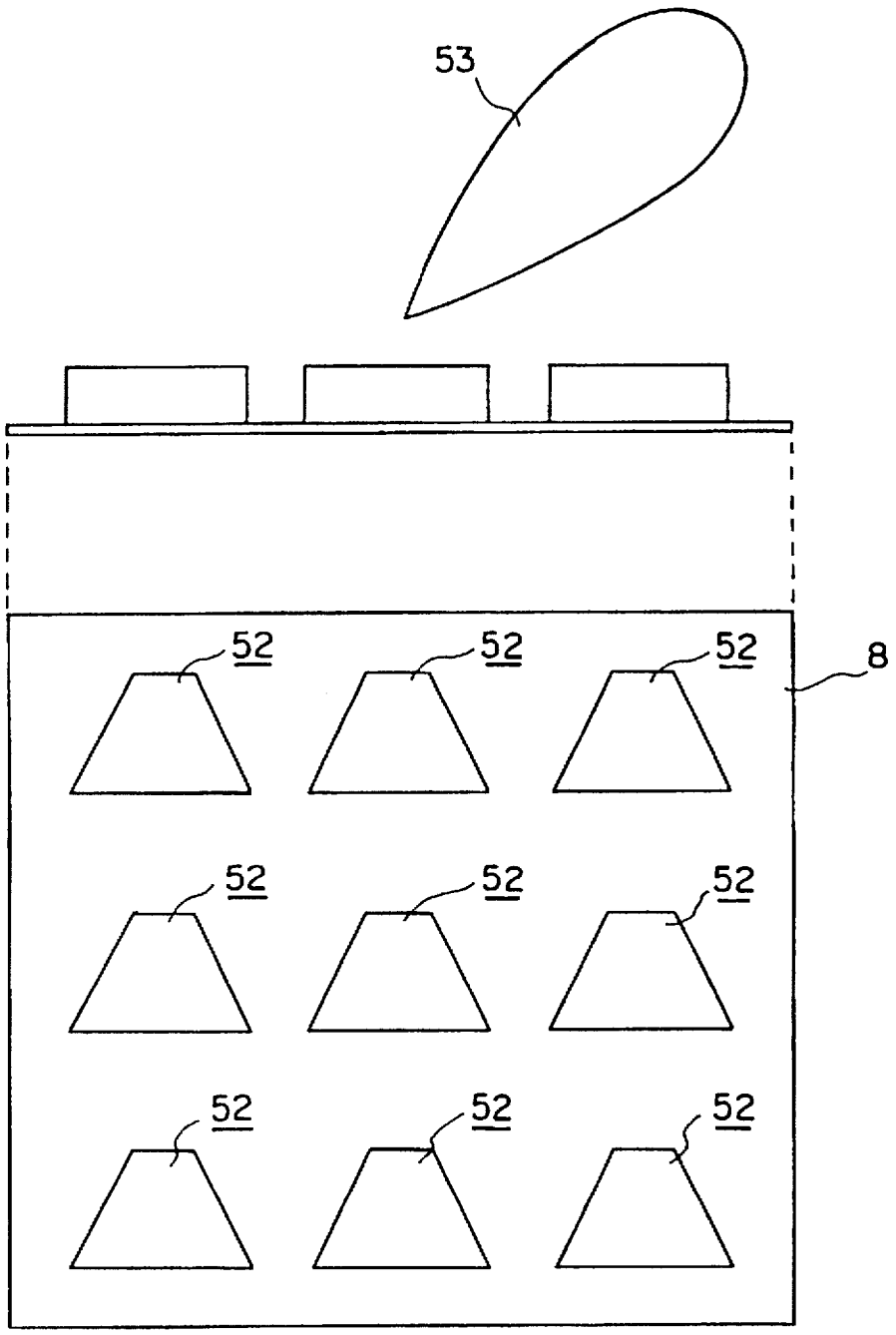
FIG. 32 is a construction drawing of the antenna apparatus according to the thirty fourth embodiment of the present invention.

FIG. 32 is a construction drawing of the antenna apparatus according to the thirty fourth embodiment of the present invention. According to the present embodiment, a plurality of the one-side shortcircuit type micro-strip antennas 52 composed of an isosceles trapezoid shaped conductive plate shown in FIG. 23 are arranged on the conductive ground plate 8 in the same direction.

By setting the feed phase of the respective one-side shortcircuit type micro-strip antennas 52 so as to form beam 53 in such a direction in which the gain of the circularly polarized signal radiated from the one-side shortcircuit type micro-strip antenna 52 maximizes, at a required value, the gain of the circular polarization of the beam 53 maximizes.

Further, by setting the feed phase of the respective one-side shortcircuit type micro-strip antenna 52 so as to form the beam 53 in such a direction in which the axial ratio of the circularly polarized signal radiated from the one-side shortcircuit type micro-strip antenna 52 minimizes, it is possible to minimize the axial ratio of the beam 53.

Embodiment 35

Although nine one-side shortcircuit type micro-strip antennas 52 are arranged in the form of a tetragon, in the thirty fourth embodiment, even if the quantity of the one-side shortcircuit type micro-strip antennas 52 is changed, it is possible to form the beam 53 in which the circular polarization gain maximizes or in which the axial ratio minimizes.

Embodiment 36

Although, in the thirty embodiment, a plurality of the one-side shortcircuit type micro-strip antennas are arranged in the form of a tetragon, even if the one-side 5 shortcircuit type micro-strip antennas are arranged in other arranging method such as in the form of a triangle, it is possible to form the beam 53 in which the circular polarization gain maximizes or in which the axial ratio minimizes.

Embodiment 37

Figure 33:
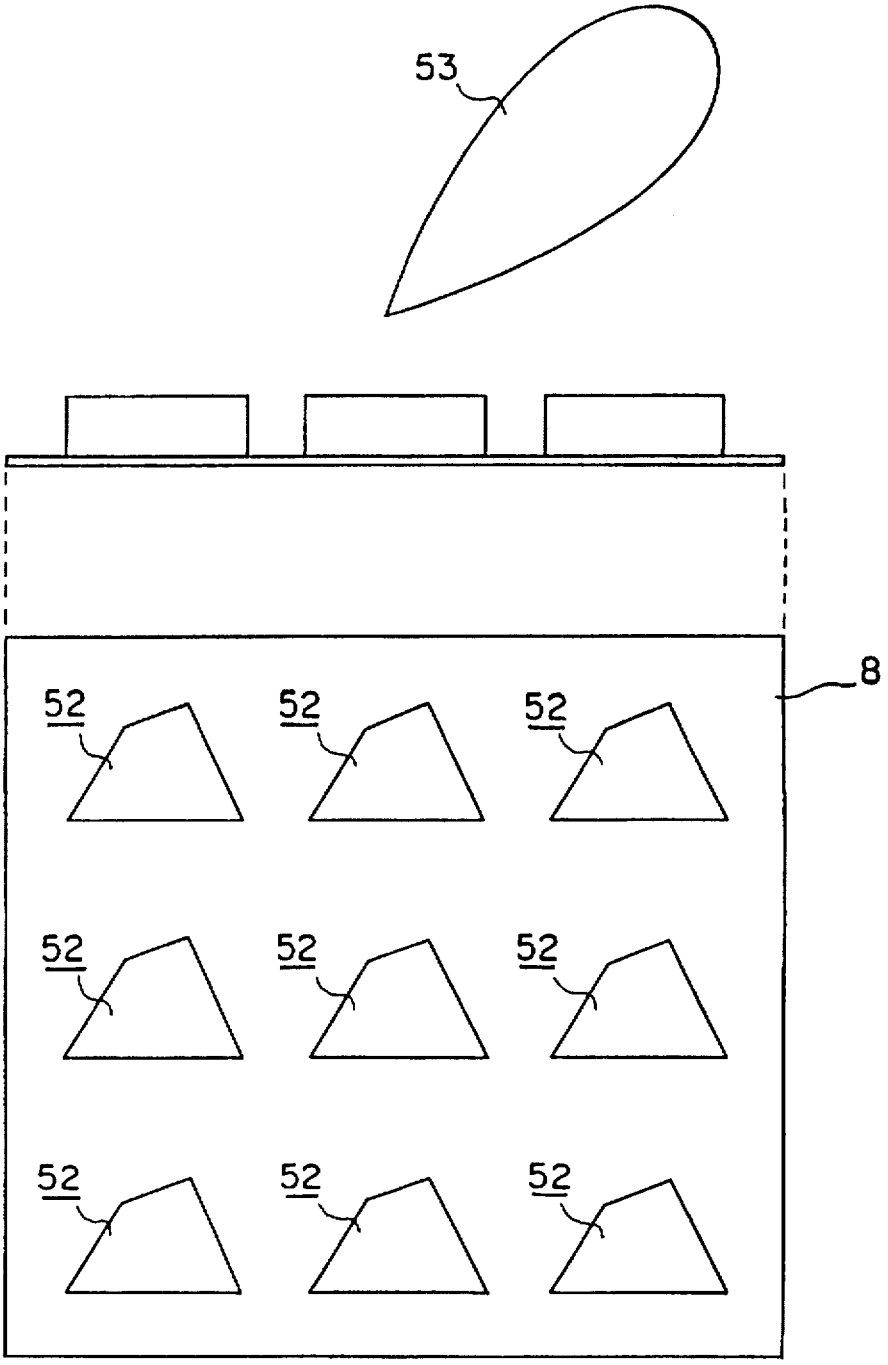
FIG. 33 is a construction drawing of the antenna apparatus according to the thirty seventh embodiment of the present invention.
Figure 34:
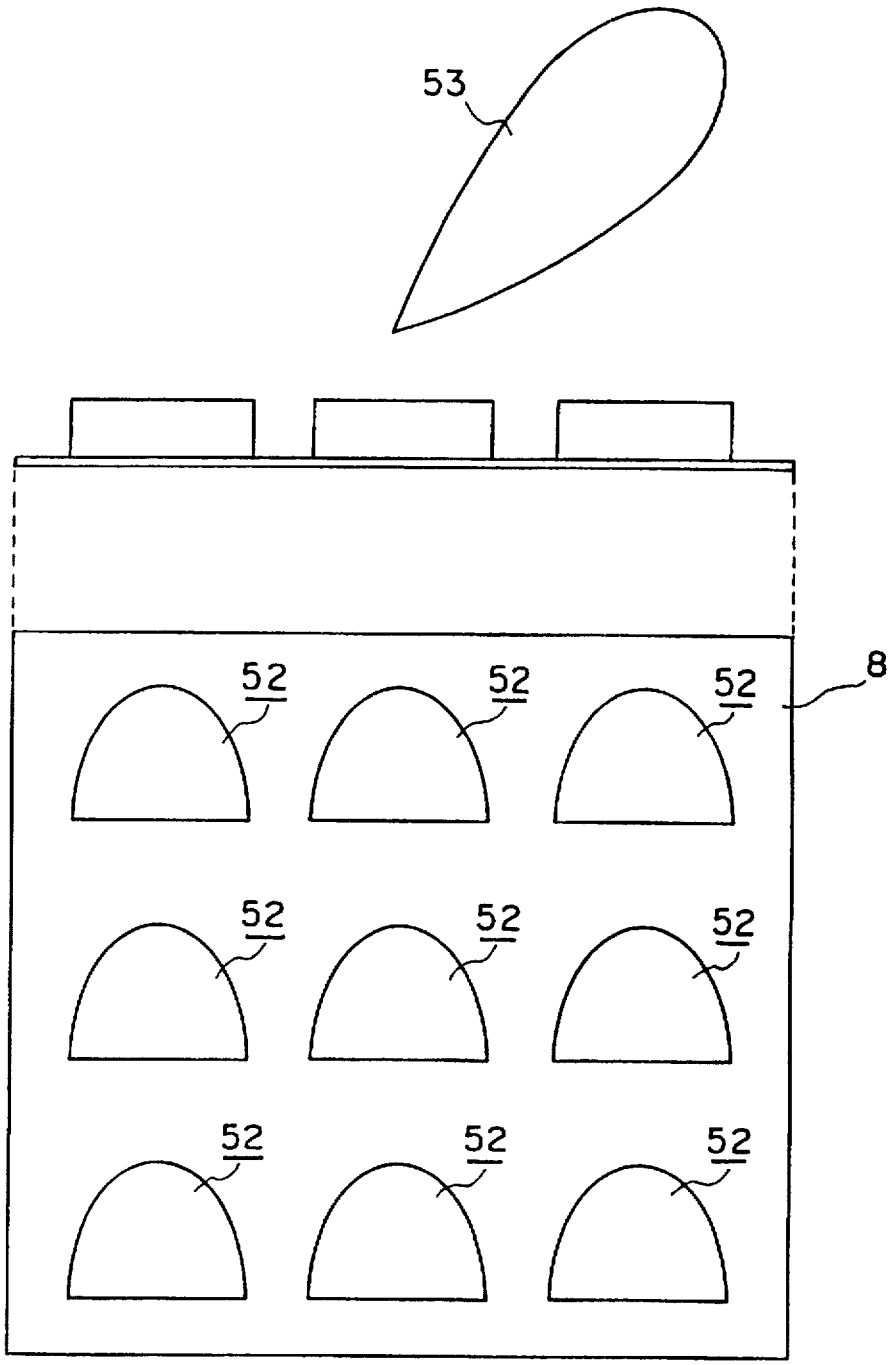
FIG. 34 is a construction drawing of another antenna apparatus according to the thirty seventh embodiment of the present invention.

Although, in the thirty fourth embodiment, the shape of the conductive plates 51 constituting the one-side shortcircuit type micro-strip antenna 52 is isosceles trapezoid, even if the shape of the conductive plate 51 is polygon or partially elliptic as shown in FIGS. 33 and 34, it is possible to form the beam 53 in which the circular polarization gain maximizes or in which the axial ratio minimizes.

Embodiment 38

Figure 35:
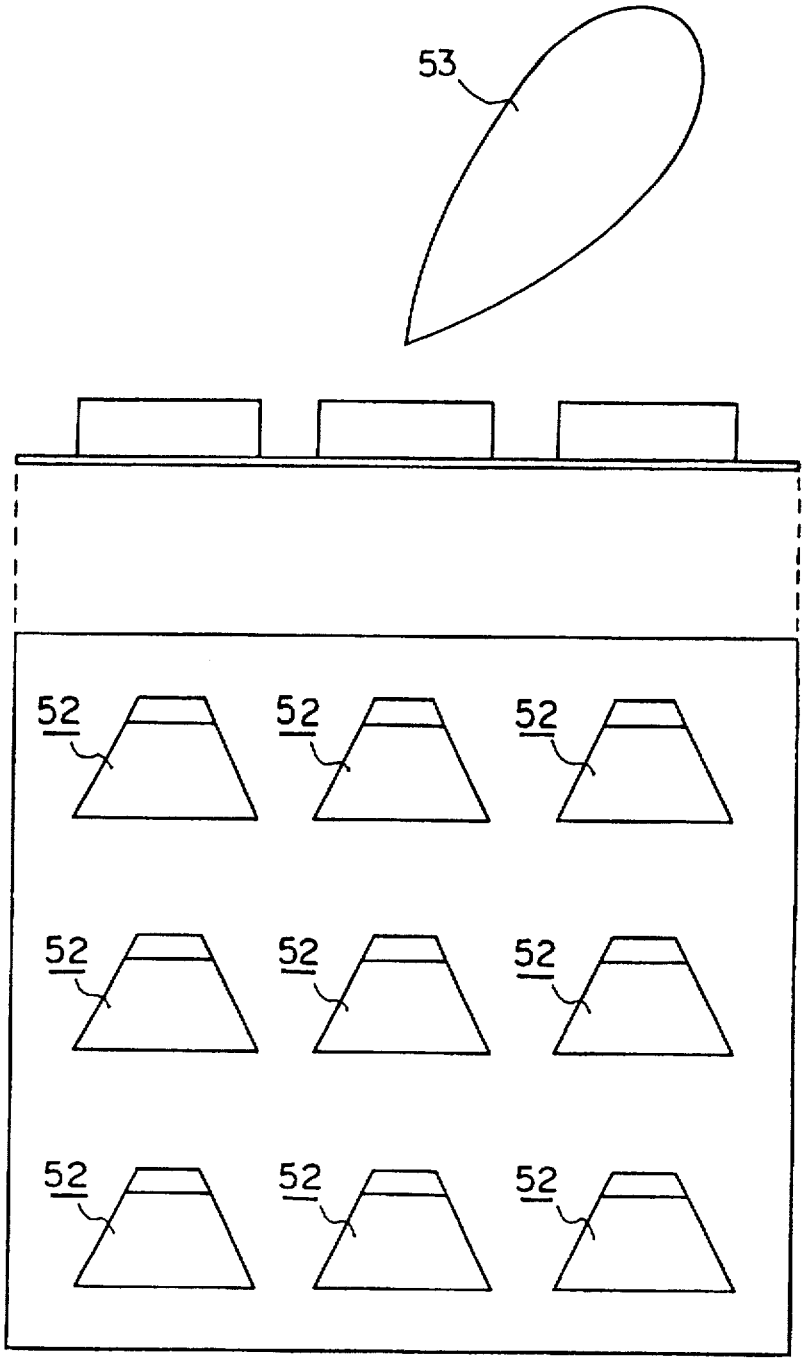
FIG. 35 is a construction drawing of the antenna apparatus according to the thirty eighth embodiment of the present invention.
Figure 36:
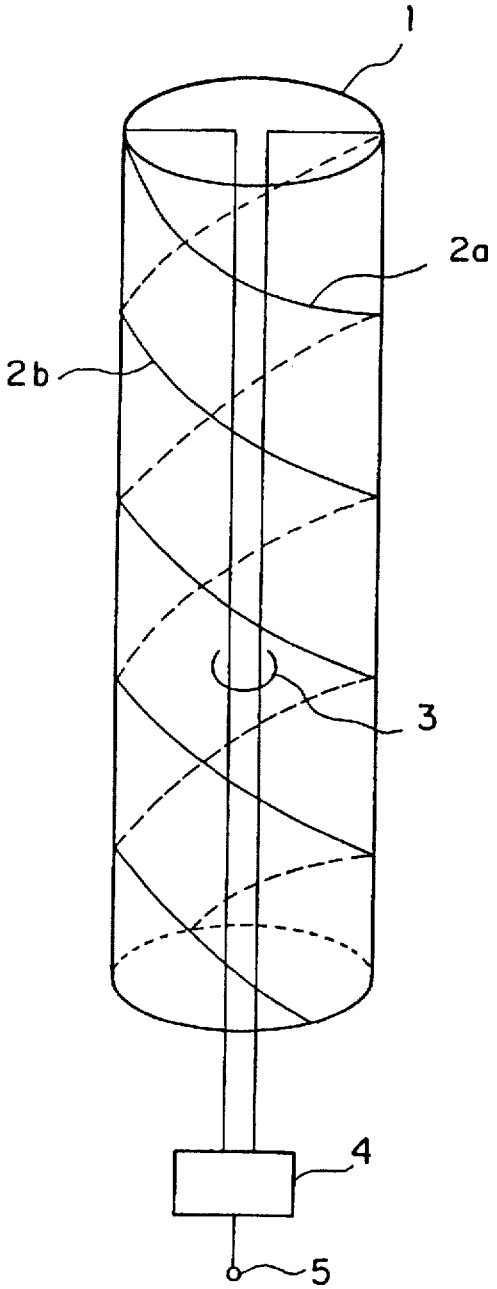
FIG. 36 (PRIOR ART)
FIG. 36 is a construction drawing of a conventional antenna apparatus.
Figure 37:
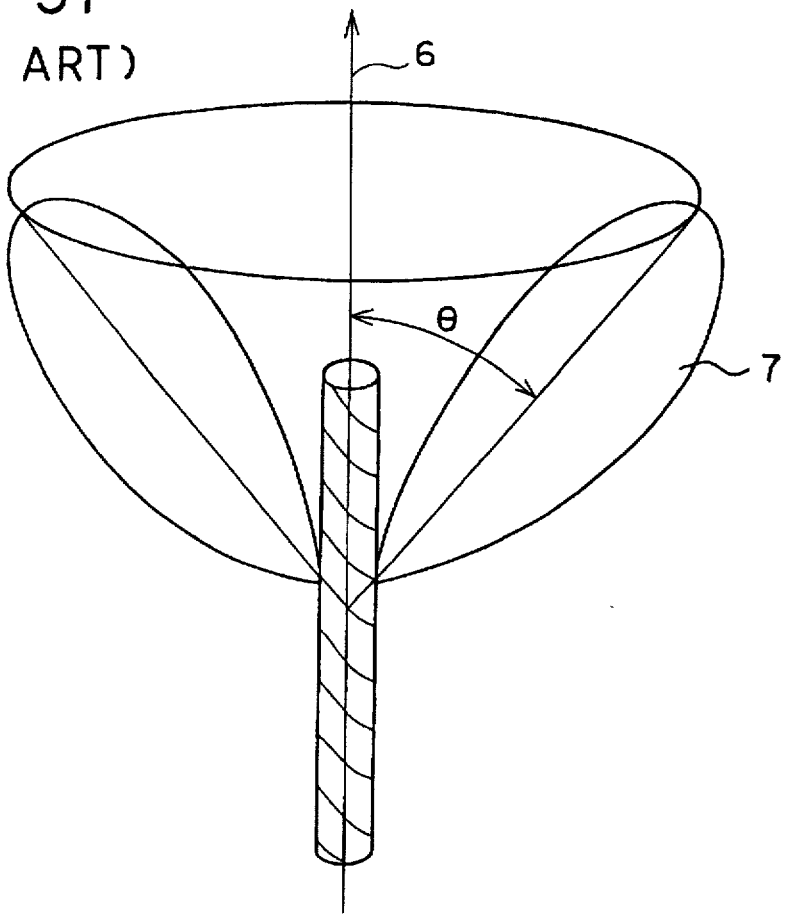
FIG. 37 (PRIOR ART)
FIG. 37 is a drawing showing the direction of beam radiation in the antenna apparatus shown in FIG. 36.
Figure 38:
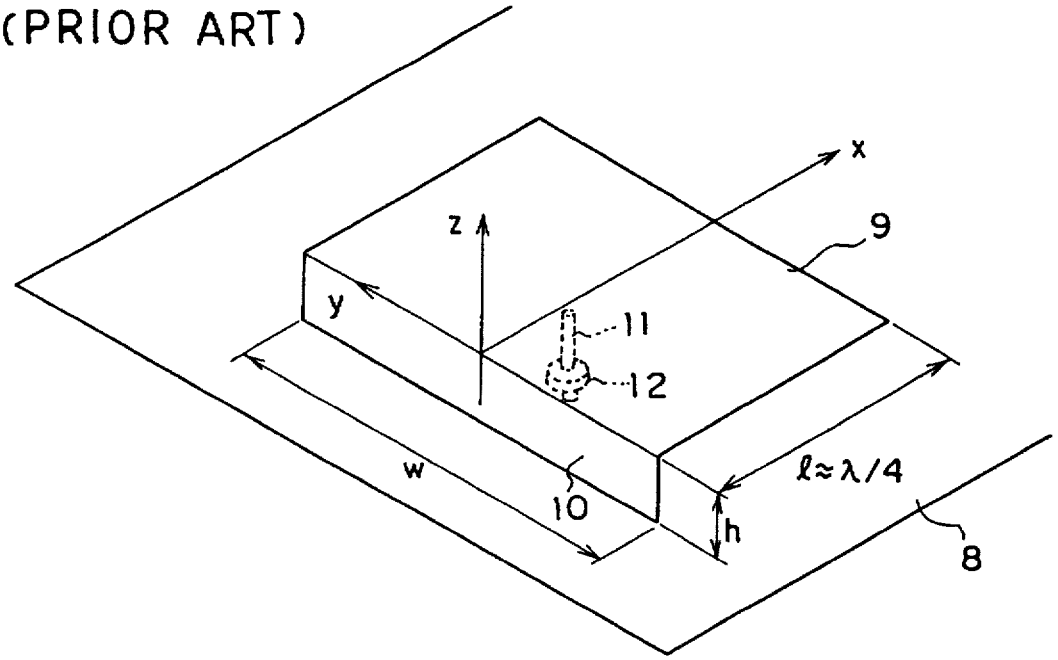
FIG. 38 (PRIOR ART)
FIG. 38 is a perspective view of another conventional antenna apparatus.
Figure 39:
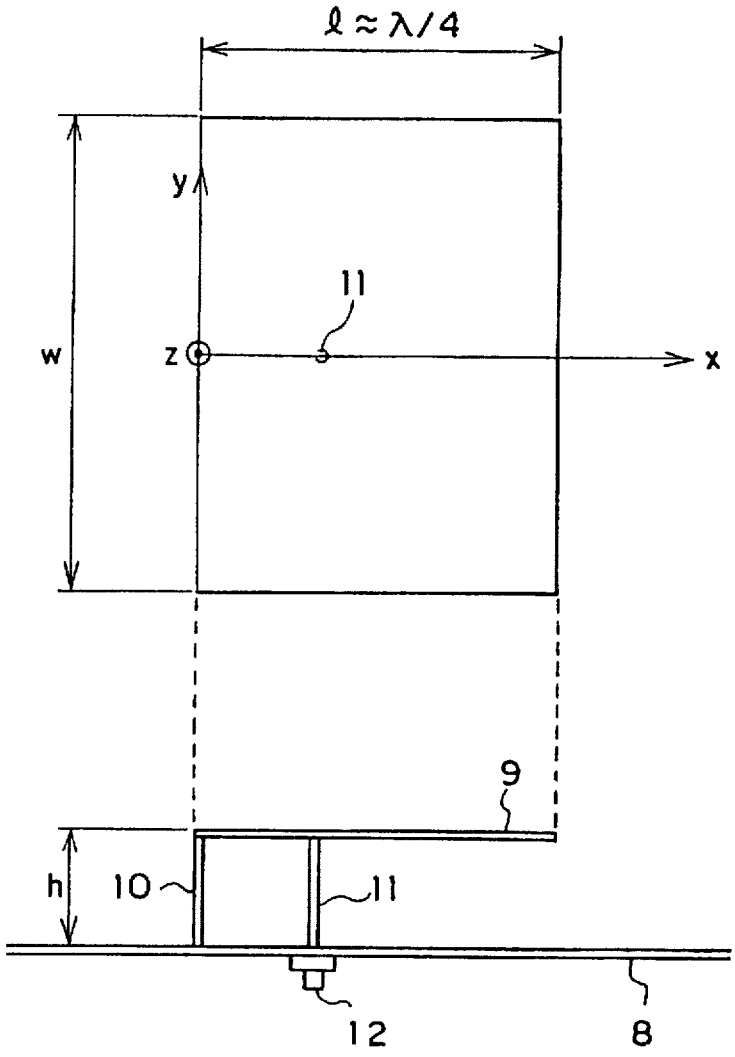
FIG. 39 (PRIOR ART)
FIG. 39 is a construction drawing of the antenna apparatus shown in FIG. 38.
Figure 40:
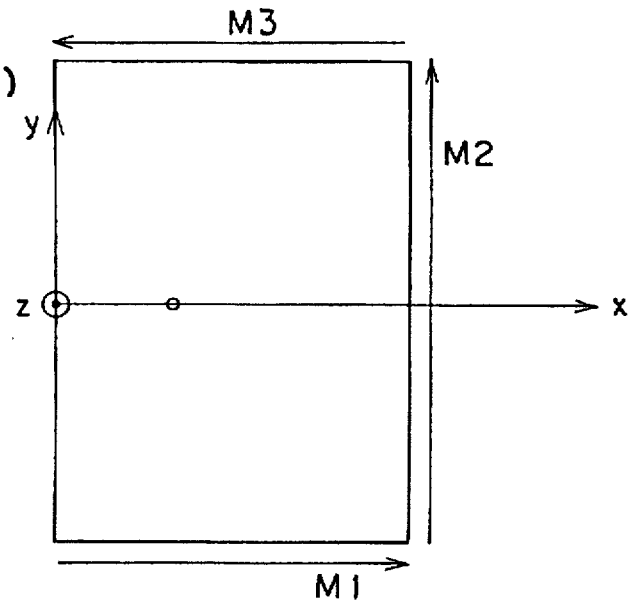
FIG. 40 (PRIOR ART)
FIG. 40 is a diagram showing magnetic currents of the antenna apparatus shown in FIG. 38.
Figure 41:
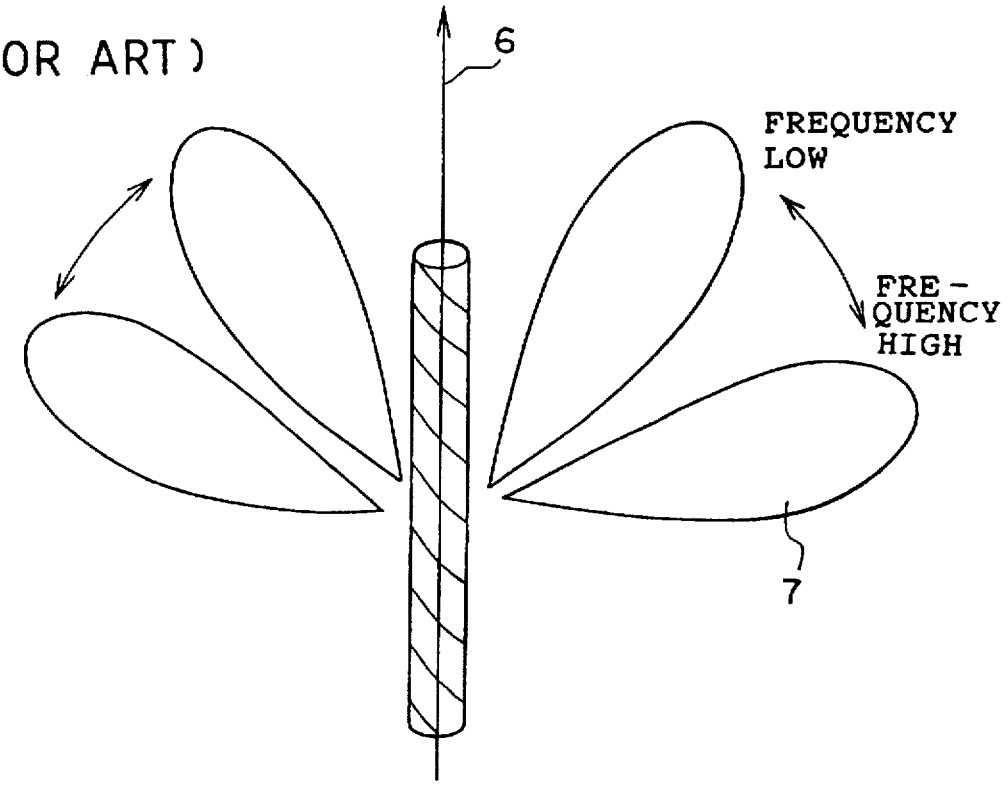
FIG. 41 (PRIOR ART)
FIG. 41 is a drawing showing the changes of the direction of beam radiation depending on the frequencies of sending and reception signals of the antenna apparatus shown in FIG. 36.
Figure 42:
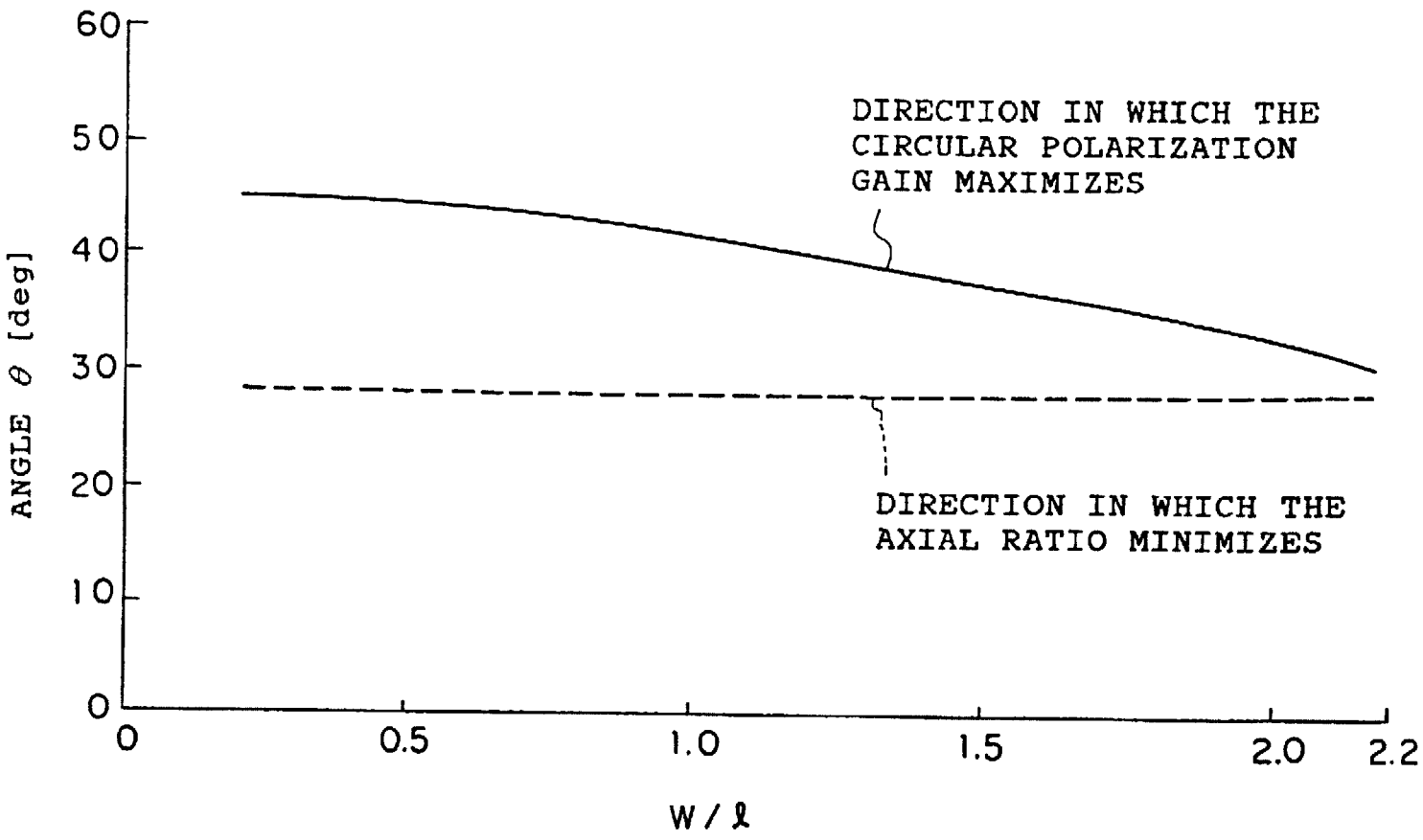
FIG. 42 (PRIOR ART)
FIG. 42 is a diagram showing the characteristics of the antenna apparatus shown in FIG. 38.

FIG. 35 is a construction drawing of the antenna apparatus according to the thirty eighth embodiment of the present invention. According to the present embodiment, a plurality of the one-side shortcircuit type micro-strip antennas 52 composed of the isosceles trapezoid shaped conductive plates 51*a*, 51*b* as shown in FIG. 30 are arranged on the conductive ground plate 8 in the same direction.

Then, by setting the supplied power phase of the respective one-side shortcircuit type micro-strip antenna 52 so as to form the beam 53 in such a direction in which the gain of the circularly polarized signal radiated from the one-side shortcircuit type micro-strip antenna 52 maximizes, the circular polarization gain of the beam 53 can be maximized.

Further, by setting the feed phase of the respective one-side shortcircuit type micro-strip antenna 52 so as to form the beam 53 in such a direction in which the axial ratio of the circularly polarized signal radiated from the one-side shortcircuit type micro-strip antenna 52 minimizes, the axial ratio of the beam 53 can be minimized.

Still further, by using two one-side shortcircuit type micro-strip antennas in coupling as a one-side shortcircuit type micro-strip antenna 52, the change of input impedance is reduced so that the band of the frequency in use can be expanded.

What is claimed is:

1. An antenna apparatus, comprising:

a plurality of non-overlapping helical antennas, each including at least one conductive wire disposed directly on a dielectric cylinder, said at least one conductive wire is spirally wound at equal intervals with a predetermined pitch, said plurality of the helical antennas being axially aligned so that the axes of said helical antennas substantially coincide end-to-end with each other; and feeding means for feeding a signal to said at least one conductive wire of said helical antennas; and wherein at least one cylindrical conductive pipe is disposed inside said dielectric cylinder and substantially coaxial with at least one of said helical antennas and said feeding means for said at least one conductive wire of said helical antennas are disposed through the inside of said at least one conductive pipe; and wherein said at least one conductive pipe is electrically insulated from said helical antennas and said feeding means.

2. An antenna apparatus comprising:

at least one helical antenna which includes at least one conductive wire disposed in the form of a cylinder, wherein said at least one conductive wire is wound spirally at a specified pitch at equal intervals;

feeding means for supplying signals to said at least one conductive wire of said at least one helical antenna; and at least one cylindrical dielectric radome separately disposed around said at least one helical antenna so as to be substantially coaxial therewith and not in contact with said at least one conductive wire, wherein said at least one cylindrical dielectric radome has a dielectric constant which changes the wavelength of a signal flowing in said at least one conductive wire so as to change the radiation direction of a conical beam of at least one of said helical antennas; and wherein the thickness of said radome is changed spirally at substantially the same pitch as the pitch of the helical antenna and the internal surface or the external surface of the dielectric radome is constructed to be of internal thread or external thread.

3. An antenna apparatus according to claim 2, wherein said at least one dielectric radome is replaceable with other dielectric radomes.

4. An antenna apparatus comprising:

at least one helical antenna which includes at least one conductive wire disposed directly on a dielectric cylinder, wherein said at least one conductive wire is wound spirally at a specified pitch at equal intervals;

feeding means connected to a feed terminal of said at least one helical antenna in order to supply signal to said at least one conductive wire of said at least one helical antenna; and phase changing means which is disposed on said at least one conductive wire and is located at a distance away from the feed terminal of the at least one conductive wire of more than ½ the overall length of the at least one conductive wire of the at least one helical antenna, so as to create divided sections of the at least one conductive wire and which makes a phase difference between the beam radiated from one of the divided sections and the beam radiated from another divided section to be approximately 180°.

5. An antenna apparatus comprising:

a first helical antenna which includes at least one conductive wire disposed directly on a dielectric cylinder wherein said at least one conductive wire is wound spirally at a predetermined pitch at equal intervals; and a second helical antenna which includes at least one conductive wire disposed directly on the dielectric cylinder wherein said at least one conductive wire is wound spirally at a different specified pitch from that of the at least one conductive wire of said first helical antenna;

a first phase changing means which is located on said at least one conductive wire and is located at a distance away from the feed terminal of the at least one conductive wire of more than ½ the overall length of the at least one conductive wire of the first helical antenna, so as to create divided sections of the at least one conductive wire and which makes a phase difference between the beam radiated from one of the divided sections and the beam radiated from the other divided section to be approximately 180°;

a second phase changing means which is located on said at least one conductive wire of said second helical antenna and is located at a distance away from the feed terminal of the at least one conductive wire of more than ½ the overall length of the at least one conductive wire of the second helical antenna, so as to create divided sections of the at least one conductive wire and which makes a phase difference between the beam radiated from one of the divided sections and the beam radiated from the other divided section to be approximately 180°; and feeding means for sending a transmission signal to either of said at least one conductive wire of said first helical antenna or said second helical antenna and for receiving a reception signal from the other helical antenna.

* * * * *